US011682335B2

(12) United States Patent
Ahn et al.

(10) Patent No.: US 11,682,335 B2
(45) Date of Patent: Jun. 20, 2023

(54) DISPLAY DEVICE AND METHOD OF DRIVING THE SAME

(71) Applicant: Samsung Display Co., Ltd., Yongin-Si (KR)

(72) Inventors: Kuk-Hwan Ahn, Uiwang-si (KR); Youngwook Yoo, Suwon-si (KR); Jungyu Lee, Seoul (KR); Hyunjun Lim, Suwon-si (KR); Byung Ki Chun, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/941,451

(22) Filed: Jul. 28, 2020

(65) Prior Publication Data

US 2021/0193017 A1 Jun. 24, 2021

(30) Foreign Application Priority Data

Dec. 19, 2019 (KR) ..... 10-2019-0170832

(51) Int. Cl.

| | |
|---|---|
| ***G09G 3/20*** | (2006.01) |
| ***G09G 3/3233*** | (2016.01) |
| ***G09G 3/3275*** | (2016.01) |
| *G09G 3/3266* | (2016.01) |

(52) U.S. Cl.

CPC ..... *G09G 3/2044* (2013.01); *G09G 3/3233* (2013.01); *G09G 3/3275* (2013.01); *G09G 3/3266* (2013.01); *G09G 2320/02* (2013.01)

(58) Field of Classification Search

CPC ... G09G 2320/0233; G09G 2320/0285; G09G 3/2044; G09G 2320/0209; G09G 2320/0242; G09G 2320/045; G09G 2320/02; G09G 3/3275

See application file for complete search history.

(56) References Cited

U.S. PATENT DOCUMENTS

| | | | |
|---|---|---|---|
| 8,913,092 | B2 | 12/2014 | Ha et al. |
| 10,019,939 | B2 | 7/2018 | Lee et al. |
| 10,386,643 | B2 | 8/2019 | Lee |
| 2008/0001869 | A1 | 1/2008 | Chung et al. |

(Continued)

FOREIGN PATENT DOCUMENTS

| | | | |
|---|---|---|---|
| KR | 10-1675852 | B1 | 11/2016 |
| KR | 10-1784216 | B1 | 10/2017 |
| KR | 10-2019-0014205 | A | 2/2019 |

*Primary Examiner* — Nelson M Rosario
*Assistant Examiner* — Scott D Au
(74) *Attorney, Agent, or Firm* — Innovation Counsel LLP

(57) ABSTRACT

A display device includes a display panel, a memory, a dithering processor, and a panel driver. The display panel includes a display surface, and the memory stores dither patterns with respect to at least one spot area included in the display surface. The dithering processor selects a dither pattern among the dither patterns in a predetermined time unit and outputs a compensation image signal corresponding to the dither pattern. The panel driver outputs a data signal corresponding to the spot area based on the compensation image signal. Each of the dither patterns includes a first grayscale area having a first grayscale value higher than a first target grayscale value of the spot area and a second grayscale area having a second grayscale value lower than the first target grayscale value.

23 Claims, 15 Drawing Sheets

(56) References Cited

U.S. PATENT DOCUMENTS

| | | | | |
|---|---|---|---|---|
| 2008/0303766 | A1* | 12/2008 | Lee | G09G 3/006 345/89 |
| 2009/0303243 | A1* | 12/2009 | Hwang | G09G 3/3648 345/530 |
| 2012/0206504 | A1* | 8/2012 | Ha | G09G 3/3208 345/690 |
| 2015/0206467 | A1* | 7/2015 | Choi | G09G 5/003 345/690 |

* cited by examiner

N-mode

L-mode

DISPLAY DEVICE AND METHOD OF DRIVING THE SAME

CROSS-REFERENCE TO RELATED APPLICATION

This U.S. non-provisional patent application claims priority under 35 U.S.C. § 119 of Korean Patent Application No. 10-2019-0170832, filed on Dec. 19, 2019, the disclosure of which is hereby incorporated by reference in its entirety.

BACKGROUND

1. Field of Disclosure

The present disclosure relates to a display device and a method of driving the same. More particularly, the present disclosure relates to a display device having an improved display quality and a method of driving the display device.

2. Description of the Related Art

In recent years, a flat panel display device, such as a liquid crystal display, a plasma display panel, an organic light emitting diode display, etc., is mainly used as an image display device.

Some image display devices employ a spot compensating scheme to compensate for a display spot generated on a display panel when the image is displayed.

SUMMARY

The present disclosure provides a display device capable of preventing a flicker phenomenon and improving a display quality.

The present disclosure provides a method of driving the display device.

According to one embodiment, a display device includes a display panel, a memory, a dithering processor, and a panel driver. The display panel includes a display surface. The memory stores dither patterns with respect to at least one spot area included in the display surface. The dithering processor selects a dither pattern of the dither patterns in a first predetermined time unit and outputs a compensation image signal corresponding to the selected dither pattern. The panel driver outputs a data signal corresponding to the spot area based on the compensation image signal.

Each of the dither patterns includes a first grayscale area having a first grayscale value higher than a first target grayscale value of the spot area and a second grayscale area having a second grayscale value lower than the first target grayscale value.

According to one embodiment, a difference in grayscale between the first grayscale value of the first grayscale area and the second grayscale value of the second grayscale area may be equal to or greater than 2.

According to one embodiment, the first target grayscale value may correspond to an average value of the first grayscale value of the first grayscale area and the second grayscale value of the second grayscale area.

According to one embodiment, the display surface further may include a non-spot area, and the non-spot area may include a non-compensation area and a boundary area between the non-compensation area and the spot area.

According to one embodiment, the display device may further include: a boundary memory storing boundary dither patterns with respect to the boundary area; and a boundary dithering processor selecting a boundary dither pattern among the boundary dither patterns in a second predetermined time unit and outputting a boundary compensation image signal corresponding to the boundary dither pattern. Each of the boundary dither patterns may include a third grayscale area having a third grayscale value higher than a second target grayscale value of the boundary area and a fourth grayscale area having a fourth grayscale value lower than the second target grayscale value.

According to one embodiment, the boundary area may include a boundary dithering area in which the boundary dithering processor performs a dithering operation using the boundary dither patterns and a non-dithering area in which the boundary dithering processor performs no dithering operation.

According to one embodiment, the third grayscale area and the fourth grayscale area may have a same size as a size of the first grayscale area and the second grayscale area.

According to one embodiment, the third grayscale area and the fourth grayscale area may have a size greater than a size of the first grayscale area and the second grayscale area.

According to one embodiment, a difference in grayscale between the third grayscale value of the third grayscale area and the fourth grayscale value of the fourth grayscale area may be equal to or greater than 2.

According to one embodiment, the boundary area may include a plurality of sub-boundary areas, and the boundary memory may store sub-compensation patterns with respect to the sub-boundary areas.

According to one embodiment, each of the sub-compensation patterns may include a first sub-grayscale area having a fifth grayscale value higher than a third target grayscale value of each of the sub-boundary areas and a second sub-grayscale area having a sixth grayscale value lower than the third target grayscale value.

According to one embodiment, each of the sub-boundary areas may include a sub-boundary dithering area in which the boundary dithering processor performs a sub-boundary dithering operation using the boundary dither patterns and a non-dithering area in which the boundary dithering processor performs no sub-boundary dithering operation, and a size of the non-dithering area may gradually increase based on a distance away from the spot area.

According to one embodiment, the first sub-boundary area and the second sub-boundary area may have a same size as a size of the first grayscale area and the second grayscale area.

According to one embodiment, a difference in grayscale between the fifth grayscale value of the first sub-boundary grayscale area and the sixth grayscale value of the second sub-boundary grayscale area may be equal to or greater than 2.

According to one embodiment, the display device may further include a spot area extractor that extracts the spot area in the display surface of the display panel.

According to one embodiment, a method of driving a display device includes: extracting at least one spot area in a display surface of a display panel; selecting a dither pattern among dither patterns with respect to the spot area in a first predetermined time unit; compensating for an image signal corresponding to the spot area based on the selected dither pattern and outputting a compensation image signal; generating a data signal with respect to the spot area based on the compensation image signal; and providing the data signal to the display panel.

Each of the dither patterns includes a first grayscale area having a first grayscale value higher than a first target grayscale value of the spot area and a second grayscale area having a second grayscale value lower than the first target grayscale value.

According to one embodiment, a difference in grayscale between the first grayscale value of the first grayscale area and the second grayscale value of the second grayscale area may be equal to or greater than 2.

According to one embodiment, the first target grayscale value may correspond to an average value of the first grayscale value of the first grayscale area and the second grayscale value of the second grayscale area.

According to one embodiment, the display surface may further include a non-spot area, and the non-spot area may include a non-compensation area and a boundary area between the non-compensation area and the spot area.

According to one embodiment, the method may further include selecting a boundary dither pattern among boundary dither patterns with respect to the boundary area in a second predetermined time unit. Each of the boundary dither patterns may include a first boundary grayscale area having a third grayscale value higher than a second target grayscale value of the boundary area and a second boundary grayscale area having a fourth grayscale value lower than the second target grayscale value.

According to one embodiment, a difference in grayscale between the third grayscale value of the first boundary grayscale area and the fourth grayscale value of the second boundary grayscale area may be equal to or greater than 2.

According to one embodiment, a display device includes a display panel, a frequency comparator, a first memory, a second memory, a first dithering processor, a second dithering processor, and a panel driver. The display panel includes a display surface. The frequency comparator compares a driving frequency of the display panel with a predetermined reference frequency. The first memory stores global dither patterns with respect to an entire area of the display surface, and the second memory stores local dither patterns with respect to at least one spot area included in the display surface. The first dithering processor selects a dither pattern among the global dither patterns in a predetermined time unit and outputs a first compensation image signal corresponding to the selected global dither pattern in a normal mode, the driving frequency being equal to or greater than the reference frequency in the normal mode. The second dithering processor selects a local dither pattern among the local dither patterns in the predetermined time unit and outputs a second compensation image signal corresponding to the selected local dither pattern in a low frequency mode, the driving frequency being smaller than the reference frequency in the low frequency mode. The panel driver outputs a global data signal with respect to the entire area based on the first compensation image signal in the normal mode and outputs a local data signal with respect to the spot area based on the second compensation image signal in the low frequency mode.

Each of the local dither patterns includes a first grayscale area having a first grayscale value higher than a first target grayscale value of the spot area and a second grayscale area having a second grayscale value lower than the first target grayscale value, and each of the global dither patterns includes a third grayscale area having a third grayscale value higher than a second target grayscale value of the entire area and a fourth grayscale area having a fourth grayscale value lower than the second target grayscale value.

According to one embodiment, a difference in grayscale between the first grayscale value of the first grayscale area and the second grayscale value of the second grayscale area may be equal to or greater than 2, and a difference in grayscale between the third grayscale value of the third grayscale area and the fourth grayscale value of the fourth grayscale area may be equal to or greater than 2.

According to one embodiment, the first target grayscale value may correspond to an average value of the first grayscale value of the first grayscale area and the second grayscale value of the second grayscale area, and the second target grayscale value may correspond to an average value of the third grayscale value of the third grayscale area and the fourth grayscale value of the fourth grayscale area.

According to one embodiment, the display device may further include a spot area extractor that extracts the spot area.

As the image signal with respect to the spot area that corresponds to a portion of the display surface is dithered using the dither patterns that are temporally and spatially distributed, the display device can prevent the spot that may be observable in the display surface.

In addition, since the dithering process may be performed locally on a portion of the display device, not on the entire area of the display surface, the display device can prevent a flicker phenomenon that may be caused by the dithering process.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

Figure 1:
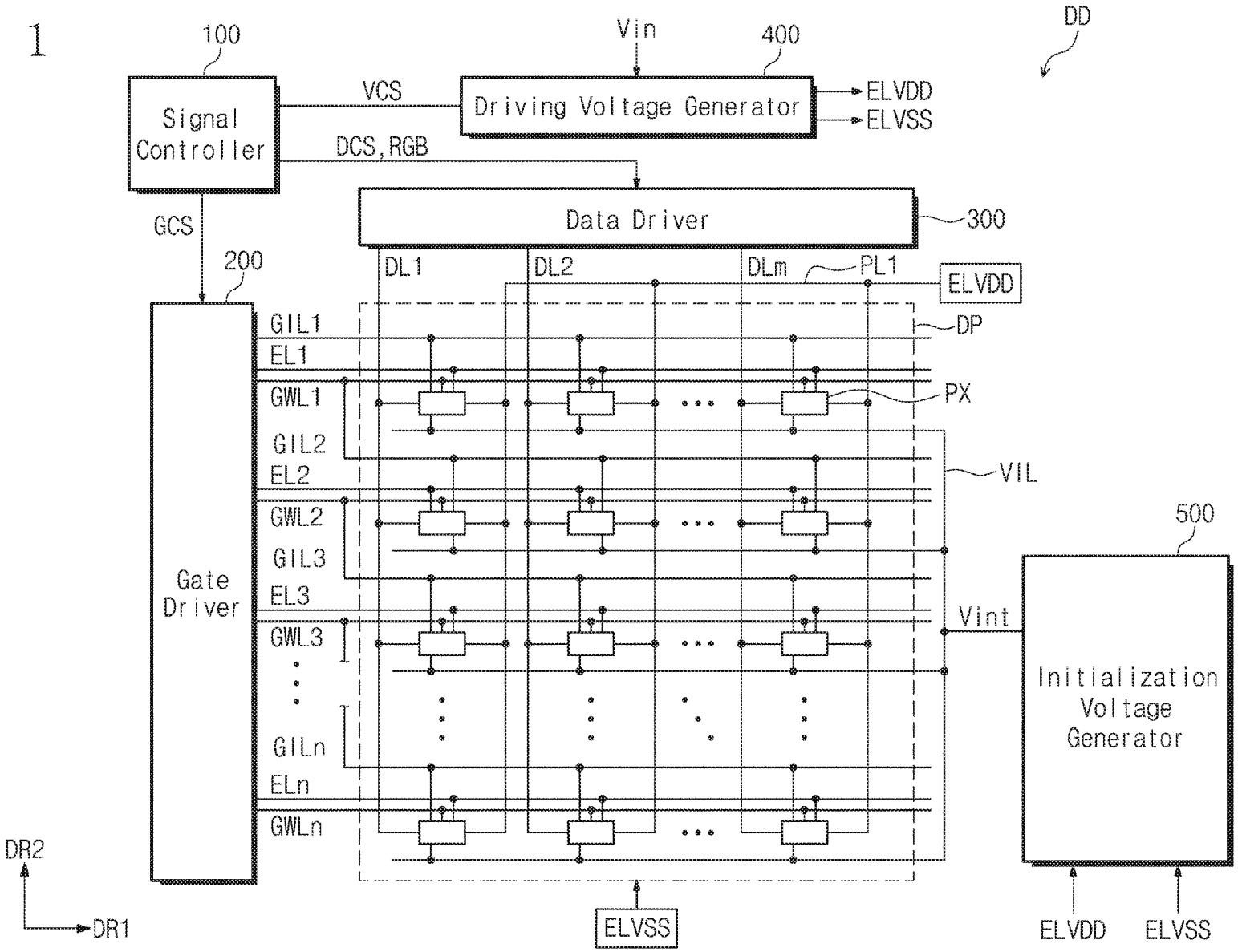
FIG. 1 is a block diagram showing a display device according to an example embodiment of the present disclosure.

In the present disclosure, it will be understood that when an element or layer is referred to as being "on," "connected to," or "coupled to" another element or layer, it can be directly on, connected, or coupled to the other element or layer, or one or more intervening elements or layers may be present.

Like numerals refer to like elements throughout the present disclosure. In the drawings, the thickness, ratio, and dimension of components may be exaggerated for effective description of the technical content.

As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of the present disclosure. As used herein, a singular form such as "a," "an," and "the" are intended to include a plural form as well, unless the context clearly indicates otherwise.

Spatially relative terms, such as "beneath," "below," "lower," "above," "upper," and the like, may be used herein for ease of description to describe one element or feature's relationship to another element(s) or feature(s) as illustrated in the figures.

Unless otherwise defined, terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be further understood that the terms "includes" and/or "including", when used in the present disclosure, specify the presence of stated features, integers, steps, operations, elements, and/or components, but do not preclude the presence or addition of one or more other features, integers, steps, operations, elements, components, and/or any group thereof.

Hereinafter, the present disclosure will be explained in detail with reference to the accompanying drawings.

Figure 2:
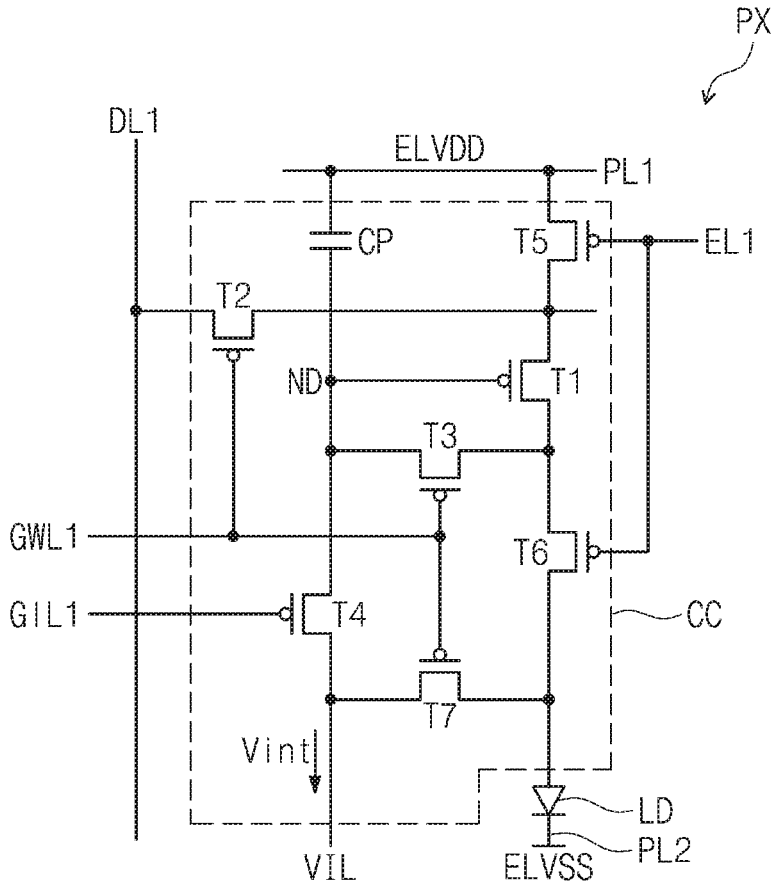
FIG. 2 is an equivalent circuit diagram showing one pixel shown in FIG. 1.
Figure 3:
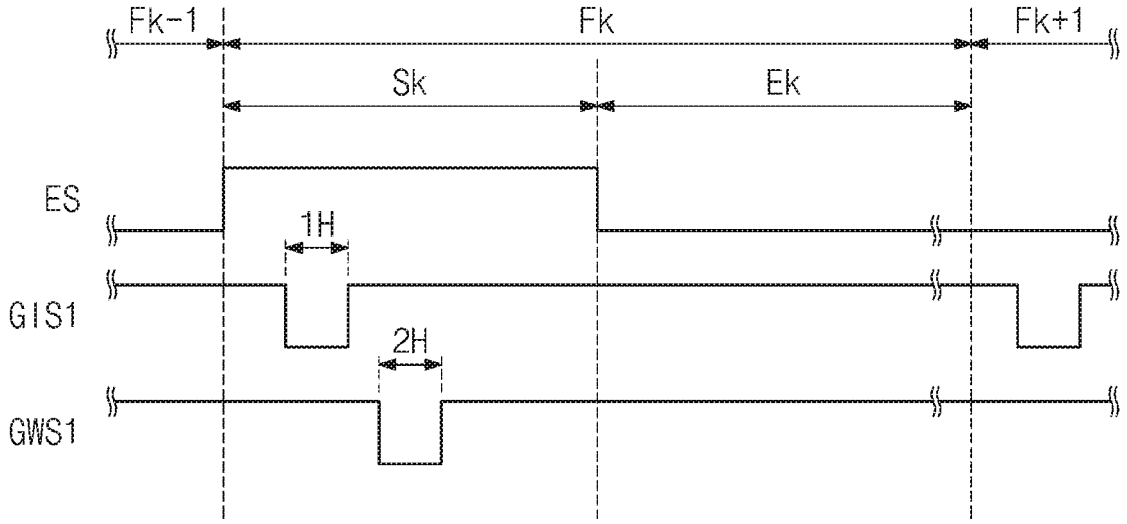
FIG. 3 is a waveform diagram showing driving signals for driving the pixel shown in FIG. 2.

FIG. 1 is a block diagram showing a display device DD according to an example embodiment of the present disclosure, FIG. 2 is an equivalent circuit diagram showing one pixel PX shown in FIG. 1, and FIG. 3 is a waveform diagram showing driving signals for driving the pixel PX shown in FIG. 2.

Referring to FIG. 1, the display device DD includes a signal controller 100, a gate driver 200, a data driver 300, a driving voltage generator 400, an initialization voltage generator 500, and a display panel DP.

The signal controller 100 receives input image signals (not shown), converts a data format of the input image signals to a data format appropriate to an interface to the data driver 300, and generates image data RGB. The signal controller 100 outputs the image data RGB and a data control signal DCS to the data driver 300.

The gate driver 200 receives a gate control signal GCS from the signal controller 100. The gate control signal GCS may include a vertical start signal that starts an operation of the gate driver 200 and a clock signal that determines an output timing of signals. The gate driver 200 may generate a plurality of gate signals and sequentially output the gate signals to a plurality of gate lines GIL1 to GILn and GWL1 to GWLn. In addition, the gate driver 200 may generate a plurality of light emitting control signals in response to the gate control signal GCS and output the light emitting control signals to a plurality of light emitting control lines EL1 to ELn.

In FIG. 1, it is shown that the gate driver 200 outputs the gate signals and the light emitting control signals, however, the present disclosure should not be limited thereto or thereby. In one embodiment of the present disclosure, a driving circuit generating and outputting the gate signals and a driving circuit generating and outputting the light emitting control signals may be separately provided.

The data driver 300 receives the data control signal DCS and the image data RGB from the signal controller 100. The data driver 300 converts the image data RGB to data signals and outputs the data signals to a plurality of data lines DL1 to DLm. The data signals may be analog voltages corresponding to grayscale values of the image data RGB.

According to an example embodiment, the gate driver 200 and the data driver 300 may be collectively referred to as a panel driver for driving the display panel DP.

The driving voltage generator 400 receives a power source voltage Vin from a power source (not shown). The driving voltage generator 400 may convert the power source voltage Vin to generate a first driving voltage ELVDD and a second driving voltage ELVSS that has a voltage level lower than that of the first driving voltage ELVDD.

The driving voltage generator 400 may include a DC-to-DC converter. The driving voltage generator 400 may include a boost converter that boosts the power source voltage Vin to generate the first driving voltage ELVDD. In addition, the driving voltage generator 400 may include a buck converter that steps down the power source voltage Vin to generate the second driving voltage ELVSS.

The driving voltage generator 400 receives a driving voltage control signal VCS from the signal controller 100. The driving voltage generator 400 may generate the first and second driving voltages ELVDD and ELVSS in response to the driving voltage control signal VCS.

The initialization voltage generator 500 receives the first and second driving voltages ELVDD and ELVSS from the driving voltage generator 400. The initialization voltage generator 500 may generate an initialization voltage Vint using the first and second driving voltages ELVDD and ELVSS. The initialization voltage Vint may have a voltage level that is different from either the first driving voltage ELVDD or the second driving voltage ELVSS.

The display panel DP includes the gate lines GIL1 to GILn and GWL1 to GWLn, the light emitting control lines EL1 to ELn, the data lines DL1 to DLm, and a plurality of pixels PX. The gate lines GIL1 to GILn and GWL1 to GWLn extend in a first direction DR1 and are arranged in a second direction DR2 perpendicular to the first direction DR1. Each of the light emitting control lines EL1 to ELn is arranged to be substantially parallel to a corresponding gate line among the gate lines GIL1 to GILn and GWL1 to GWLn. The data lines DL1 to DLm are insulated from the gate lines GIL1 to GILn and GWL1 to GWLn while crossing the gate lines GIL1 to GILn and GWL1 to GWLn.

Each of the pixels PX is connected to corresponding gate lines of the gate lines GIL1 to GILn and GWL1 to GWLn, a corresponding light emitting control line of the light emitting control lines EL1 to ELn, and a corresponding data line of the data lines DL1 to DLm. FIG. 1 shows an example in which each of the pixels PX is connected to two gate lines of the gate lines GIL1 to GILn and GWL1 to GWLn, however, the present disclosure should not be limited thereto or thereby. For example, each pixel PX may be connected to one gate line or three or more gate lines.

The display panel DP receives the first driving voltage ELVDD and the second driving voltage ELVSS. The first driving voltage ELVDD is provided to the pixels PX through a first power line PL1. The second driving voltage ELVSS is provided to the pixels PX through electrodes (not shown) formed in the display panel DP and/or a second power line PL2.

The display panel DP receives the initialization voltage Vint. The initialization voltage Vint is provided to the pixels PX through an initialization voltage line VIL.

Referring to FIG. 2, the pixel PX includes a light emitting element LD and a circuit part CC controlling light emission of the light emitting element LD. The pixels PX included in display panel DP may include red pixels emitting a red color, green pixels emitting a green color, and blue pixels emitting a blue color. A light emitting element of a red pixel, a light emitting element of a green pixel, and a light emitting element of a blue pixel may include organic light emitting layers having different materials from each other.

The circuit part CC includes a plurality of transistors T1 to T7 (e.g., thin film transistors) and a capacitor CP. The transistors T1 to T7 and the capacitor CP control an amount of current flowing through the light emitting element LD in response to the data signal and the gate signal provided to the pixel PX.

Each of the transistors T1 to T7 includes an input electrode (or a source electrode), an output electrode (or a drain electrode), and a control electrode (or a gate electrode). In the present disclosure, for the convenience of explanation, one electrode of the input electrode and the output electrode is referred to as a "first electrode," and the other electrode of the input electrode and the output electrode is referred to as a "second electrode." Hereinafter, for the convenience of explanation, the transistors T1, T2, T3, T4, T5, T6, and T7 are referred to as first, second, third, fourth, fifth, sixth, and seventh transistors T1, T2, T3, T4, T5, T6, and T7, respectively.

A first electrode of the first transistor T1 is connected to the first power line PL1 via the fifth transistor T5. The first driving voltage ELVDD is provided to the first power line PL1. A second electrode of the first transistor T1 is connected to an anode electrode of the light emitting element LD via the sixth transistor T6.

The first transistor T1 controls an amount of current flowing through the light emitting element LD in response to a voltage applied to a control electrode of the first transistor T1.

The second transistor T2 is connected between a first data line DL1 and the first electrode of the first transistor T1. A control electrode of the second transistor T2 is connected to a first current gate line GWL1. When a first current gate signal is provided to the first current gate line GWL1, the second transistor T2 is turned on, and the first data line DL1 is electrically connected to the first electrode of the first transistor T1.

The third transistor T3 is connected between the second electrode of the first transistor T1 and the control electrode of the first transistor T1. A control electrode of the third transistor T3 is connected to the first current gate line GWL1. When the first current gate signal is provided to the first current gate line GWL1, the third transistor T3 is turned on, and the second electrode of the first transistor T1 is electrically connected to the control electrode of the first transistor T1, thereby connecting the first transistor T1 in a diode configuration.

The fourth transistor T4 is connected between a node ND and the initialization voltage line VIL. A control electrode of the fourth transistor T4 is connected to a first previous gate line GIL1 The node ND is connected to the fourth transistor T4 and the control electrode of the first transistor T1. When a first previous gate signal is provided to the first previous gate line GIL1 the fourth transistor T4 is turned on, and the initialization voltage Vint is provided to the node ND.

The fifth transistor T5 is connected between the first power line PL1 and the first electrode of the first transistor T1. The sixth transistor T6 is connected between the second electrode of the first transistor T1 and the anode electrode of the light emitting element LD. A control electrode of the fifth transistor T5 and a control electrode of the sixth transistor T6 are connected to a first light emitting control line EL1.

The seventh transistor T7 is connected between the initialization voltage line VIL and the anode electrode of the light emitting element LD. A control electrode of the seventh transistor T7 is connected to the first current gate line GWL1. When the first current gate signal is provided to the first current gate line GWL1, the seventh transistor T7 is turned on, and the initialization voltage Vint is provided to the anode electrode of the light emitting element LD.

The seventh transistor T7 may improve a black expression ability of the pixel PX. More specifically, when the seventh transistor T7 is turned on, the initialization voltage Vint is provided through due to the seventh transistor T7, and a parasitic capacitance (not shown) of the light emitting element LD may be discharged. Therefore, when a data signal corresponding to a black luminance is received through the first data line DL1, the light emitting element LD may accurately represent the black luminance without emitting a light despite leakage current through the first transistor T1, and thus, the pixel may improve the black expression ability.

Although FIG. 2 shows that the control electrode of the seventh transistor T7 is connected to the first current gate line GWL1, the present disclosure should not be limited thereto or thereby. In another embodiment, the control electrode of the seventh transistor T7 may be connected to another gate line, for example, a second current gate line GWL2 (refer to FIG. 1) that provides another gate signal that is different from the first current gate signal.

The first to seventh transistors T1 to T7 may be implemented as P-type metal-oxide-semiconductor (PMOS) transistors, however, they should not be limited thereto or thereby. In some embodiments, some or all of the first to seventh transistors T1 to T7 may be implemented as N-type metal-oxide-semiconductor (NMOS) transistors.

The capacitor CP is disposed between the first power line PL1 and the node ND. The capacitor CP may be charged with a voltage corresponding to the data signal. When the fifth transistor T5 and the sixth transistor T6 are turned on by a first light emitting control signal provided through the first light emitting control line EL1, the amount of the current flowing through the first transistor T1 is determined by the voltage charged in the capacitor CP.

The light emitting element LD is electrically connected to the sixth transistor T6 and the second power line PL2. The anode electrode of the light emitting element LD is connected to the sixth transistor T6, and a cathode electrode of the light emitting element LD is connected to the second power line PL2. The second driving voltage ELVSS is applied to the second power line PL2. The second driving voltage ELVSS has a voltage level lower than the first driving voltage ELVDD. Therefore, the light emitting element LD emits the light in response to a voltage corresponding to a difference between the signal that is transmitted through the sixth transistor T6 and the second driving voltage ELVSS that is provided through the second power line PL2.

Referring to FIGS. 1 to 3, the display device DD displays a unit image every frame periods Fk−1, Fk, and Fk+1. Each of the pixels PX shown in FIG. 1 receives a corresponding data signal every frame period Fk−1, Fk, or Fk+1.

FIG. 3 shows the frame periods Fk−1, Fk, and Fk+1 of the pixel PX shown in FIG. 2. Hereinafter, the driving signals for driving the pixels PX will be described centering on a k-th frame period Fk. The k-th frame period Fk includes a scan period Sk and an emission period Ek.

A first previous gate signal GIS1 is applied to the first previous gate line GIL1 in the scan period Sk. In FIG. 3, the signals are shown to be activated when they have a low level. The low level of the signals shown in FIG. 3 may correspond to a turn-on voltage of transistors to which the signals are applied. However, it is noted that the present disclosure is not limited thereto or thereby, and a high level of the signals may be used to activate the corresponding signals.

In response to the first previous gate signal GIS1, the node ND is initialized to the initialization voltage Vint.

Subsequent to the first previous gate signal GIS1, a first current gate signal GWS1 is applied to the first current gate line GWL1 in the scan period Sk. The second transistor T2 and the third transistor T3 are turned on by the first current gate signal GWS1, and the data signal applied to the first data line DL1 is provided to the node ND.

After that, a current path is formed between the node ND and the organic light emitting diode LD by a light emitting control signal ES applied to the first light emitting control line EL1 during the emission period Ek. In FIG. 3, the light emitting control signal ES is shown to be in a low state during the emission period Ek. Thus, the organic light emitting diode LD emits the light during the emission Ek. The light emitting control signal ES may be deactivated during the scan period Sk, and the light emitting control signal ES has a high level during the scan period Sk.

Figure 4:
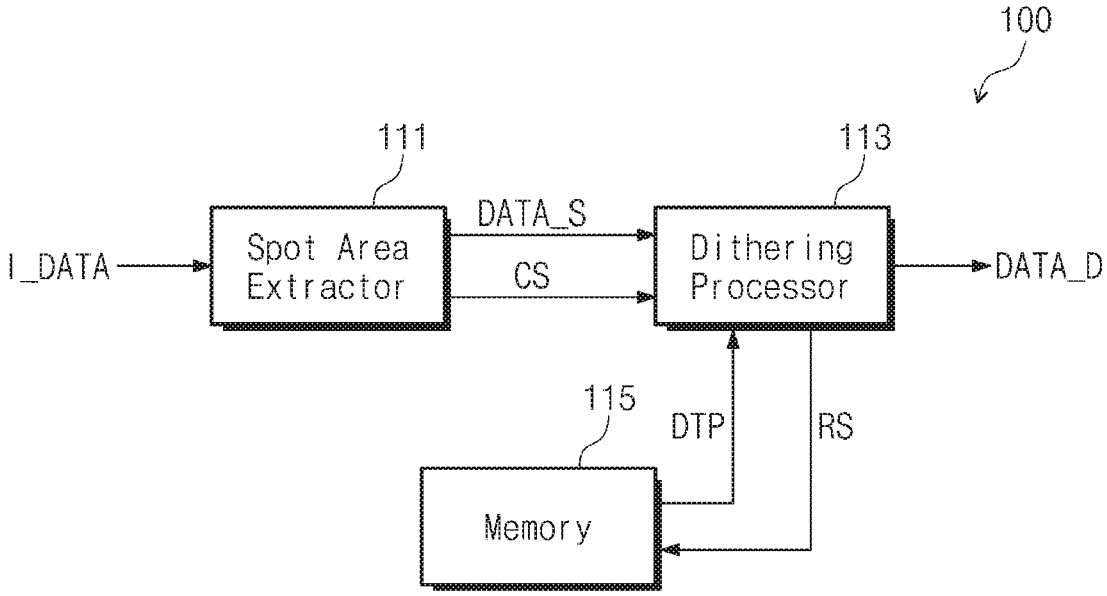
FIG. 4 is an internal block diagram showing a signal controller according to an example embodiment of the present disclosure.
Figure 5:
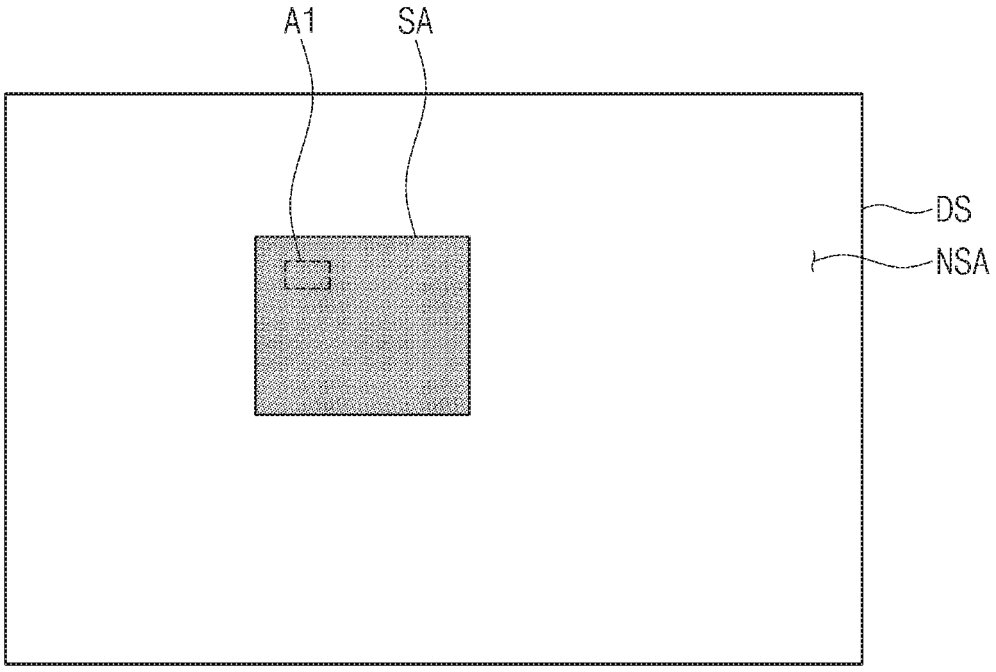
FIG. 5 is a plan view showing a display surface of a display panel shown in FIG. 1.

FIG. 4 is an internal block diagram showing the signal controller 100 shown in FIG. 1, and FIG. 5 is a plan view showing a display surface of the display panel DP shown in FIG. 1.

Referring to FIGS. 4 and 5, the signal controller 100 according to the example embodiment of the present disclosure includes a spot area extractor 111, a dithering processor 113, and a memory 115.

The spot area extractor 111 receives an input image signal I_DATA from an external device (not shown). The spot area extractor 111 may extract a spot area SA in which a spot appears on a display surface DS of the display panel DP (refer to FIG. 1) based on the input image signal I_DATA. The display surface DS includes the spot area SA in which the spot appears and a non-spot area NSA in which no spot appears.

FIG. 5 shows one spot area SA on the display surface DS, however, the present disclosure should not be limited thereto or thereby. That is, the spot area extractor 111 may extract one or more spot areas SA on the display surface DS depending on grayscale information of the displayed image. In addition, the spot area SA shown in FIG. 5 has a quadrangular shape, however, the shape of the spot area SA should not be limited to the quadrangular shape. As an example, the spot area SA may have a regular shape, such as a circular shape or a lozenge shape, or may have an irregular shape.

After detecting the spot area SA, the spot area extractor 111 provides an image signal DATA_S corresponding to the detected spot area SA among the input image signals I_DATA to the dithering processor 113. In a case where a plurality of the spot areas SA is detected, the spot area extractor 111 may provide the image signal DATA_S corresponding to each spot area SA to the dithering processor 113.

The dithering processor 113 performs a dithering operation on the image signal DATA_S received from the spot area extractor 111. When the spot area extractor 111 did not detect any spot area SA, the dithering processor 113 may not perform the dithering operation. That is, when the spot area extractor 111 did not detect any spot area SA, the display surface DS includes only the non-spot area NSA, and the dithering processor 113 may not perform the dithering operation.

The spot area extractor 111 outputs a compensation control signal CS to control an operation of the dithering processor 113. The dithering processor 113 performs the dithering operation in response to the compensation control signal CS. For example, when the spot area extractor 111 does not detect a spot area SA, the spot area extractor 111 provides the compensation control signal CS in a first state to the dithering processor 113, and the dithering processor 113 does not perform the dithering operation in response to the compensation control signal CS in the first state. When the spot area extractor 111 detects a spot area SA, the spot area extractor 111 provides the compensation control signal CS in a second state to the dithering processor 113, and the dithering processor 113 performs the dithering operation in response to the compensation control signal CS in the second state.

The dithering processor 113 receives dither patterns DTP from the memory 115 to perform the dithering operation. The memory 115 may include a look-up table storing the dither patterns DTP corresponding to the image signal DATA_S. In one embodiment, the dithering processor 113 may send a request signal RS to the memory 115, and the memory 115 may provide the dither patterns DTP corresponding the image signal DATA_S to the dithering processor 113.

The dithering processor 113 reflects the dither patterns DTP received from the memory 115 to the image signal DATA_S and outputs a compensated image signal DATA_D. The signal controller 100 combines the compensated image signal DATA_D that corresponds to the spot area SA with a non-compensated image signal that corresponds to the non-spot area NSA and provides the combined signal to the data driver 300 (shown in FIG. 1).

Figure 6:
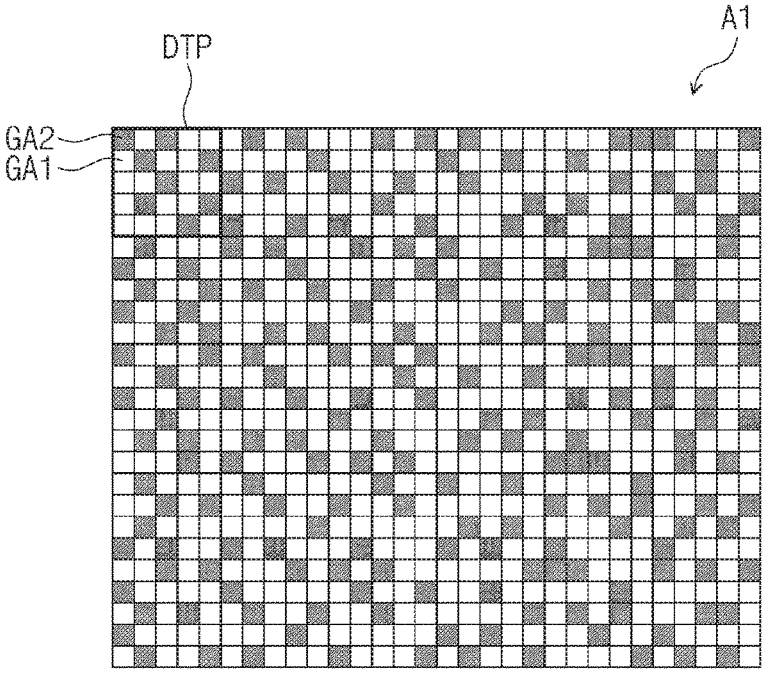
FIG. 6 shows dither patterns corresponding to a first area A1 shown in FIG. 5.
Figure 7:
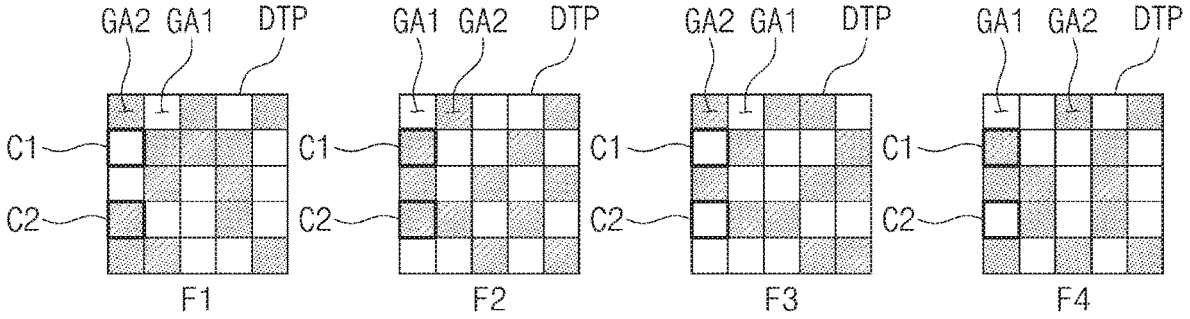
FIG. 7 shows dither patterns shown in FIG. 6 in a unit of a frame period.
Figure 8A:
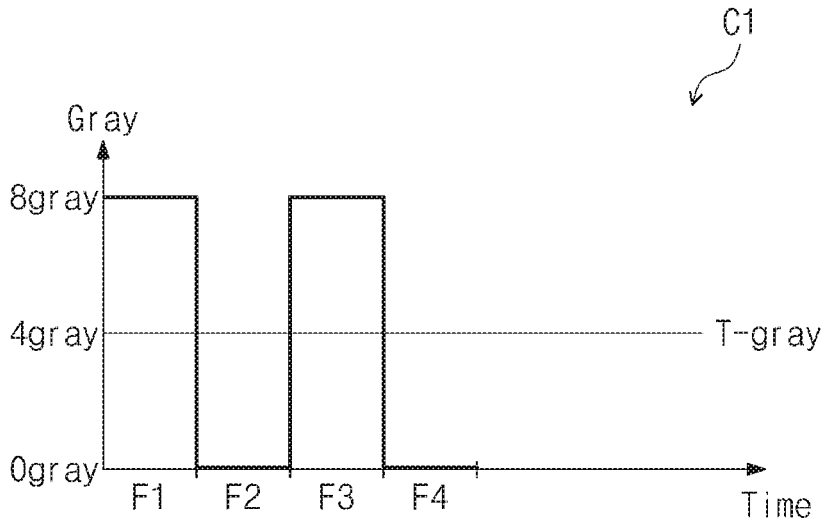
FIG. 8A is a graph showing grayscale values with respect to a first portion C1 shown in FIG. 7 in the unit of the frame period.
Figure 8B:
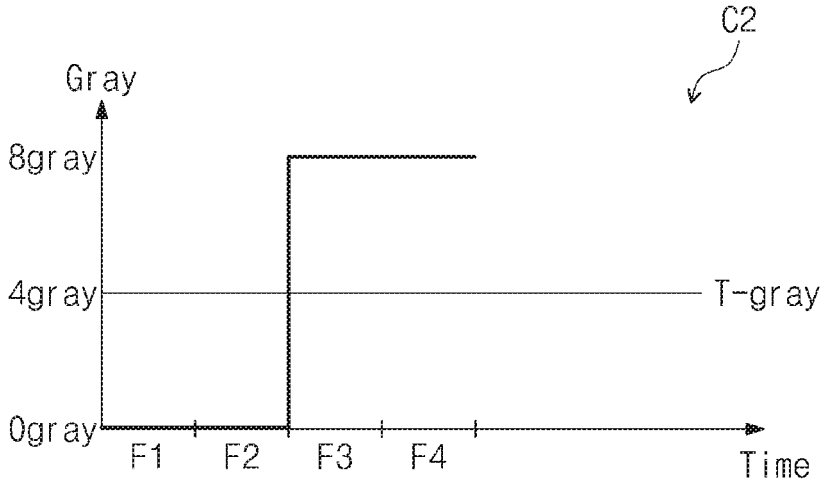
FIG. 8B is a graph showing grayscale values with respect to a second portion C2 shown in FIG. 7 in the unit of the frame period.

FIG. 6 shows dither patterns corresponding to a first area A1 shown in FIG. 5, and FIG. 7 shows dither patterns shown in FIG. 6 in a unit of a frame period. FIG. 8A is a graph showing grayscale values with respect to a first portion C1 shown in FIG. 7 in the unit of the frame period, and FIG. 8B is a graph showing grayscale values with respect to a second portion C2 shown in FIG. 7 in the unit of the frame period.

FIGS. 5 and 6 show an example of the dither patterns DTP corresponding to an area, e.g., the first area A1, of the spot area SA. As an example embodiment of the present disclosure, each of the dither patterns DTP may include five by five (5×5) grayscale areas. However, this is merely an example, and the number of the grayscale areas included in each dither pattern DTP should not be limited thereto or thereby. That is, each dither pattern DTP may include N by N (N×N) grayscale areas, and "N" may be a natural number equal to or greater than 1.

As an example of the present disclosure, the dither patterns DTP that are spatially distributed are set to correspond to the first area A1, however, the present disclosure should not be limited thereto or thereby. One dither pattern DTP may be set to a size corresponding to the first area A1. The first area A1 may correspond to an area having the same target grayscale value. The spot area SA may include a plurality of areas having target grayscale values that are different from each other.

In one embodiment, the grayscale areas arranged in each dither pattern DTP are classified into a first grayscale area GA1 and a second grayscale area GA2. The first grayscale area GA1 may correspond to an area having a grayscale value higher than a target grayscale value to be displayed in the first area A1, and the second grayscale area GA2 may correspond to an area having a grayscale value lower than the target grayscale value. Therefore, a difference in grayscale between the first grayscale area GA1 and the second grayscale area GA2 may be greater than one grayscale. In one embodiment of the present disclosure, an average value of the grayscale value of the first grayscale area GA1 and the grayscale value of the second grayscale area GA2 may be substantially the same as the target grayscale value.

In the present example embodiment, each of the first and second gray scale areas GA1 and GA2 may correspond to one pixel area in which each pixel PX of the display panel DP (shown in FIG. 1) is disposed, however, the present disclosure should not be limited thereto or thereby. That is, each of the first and second grayscale areas GA1 and GA2 may correspond to two or more pixel areas.

The first and second grayscale areas GA1 and GA2 may be distributed in each dither pattern DTP. For the convenience of explanation, the first grayscale area GA1 is indicated by a white area, and the second grayscale area GA2 is indicated by a hatched area in FIGS. 6 and 7.

Referring to FIG. 7, the first and second grayscale areas GA1 and GA2 of the dither pattern DTP have different arrangements according to a predetermined time. The first and second grayscale areas GA1 and GA2 of the dither pattern DTP may have the different arrangements in a unit of one frame period. That is, the dither pattern DTP may have different patterns in the unit of one frame period.

The dither pattern DTP may have first, second, third, and fourth patterns that are different from each other during first, second, third, and fourth frame periods F1, F2, F3, and F4 that are successive to each other. The dither pattern DTP in each of the first to fourth frame periods F1 to F4 may be randomly selected from K patterns having different patterns from each other. Here, "K" is a natural number equal to or greater than 2.

The dither pattern DTP has the first dither pattern during the first frame period F1. In the first dither pattern, the first portion C1 of the dither pattern DTP is set as the first grayscale area GA1, and the second portion C2 of the dither pattern DTP is set as the second grayscale area GA2.

The dither pattern DTP has the second dither pattern that is different from the first dither pattern during the second frame period F2. In the second dither pattern, the first and second portions C1 and C2 of the dither pattern DTP are set as the second grayscale area GA2.

The dither pattern DTP has the third dither pattern that is different from the first and second dither patterns during the third frame period F3. In the third dither pattern, the first and second portions C1 and C2 of the dither pattern DTP are set as the first grayscale area GA.

The dither pattern DTP has the fourth dither pattern that is different from the first, second, and third dither patterns during the fourth frame period F4. In the fourth dither pattern, the first portion C1 of the dither pattern DTP is set as the second grayscale area GA2, and the second portion C2 of the dither pattern DTP is set as the first grayscale area GAL FIGS. 8A and 8B show an example in which the target grayscale value T-gray of the dither pattern DTP is 4. The first grayscale area GA1 has a grayscale value (e.g., 8) higher than the target grayscale value T-gray, and the second grayscale area GA2 has a grayscale value (e.g., 0) lower than the target grayscale value T-gray. In the present example, a difference in grayscale between the first grayscale area GA1 and the second grayscale area GA2 is eight grayscales.

Referring to FIG. 7, the first portion C1 has the grayscale value of 8 during the first and third frame periods F1 and F3 and the grayscale value of 0 during the second and fourth frame periods F2 and F4. The second portion C2 has the grayscale value of 0 during the first and second frame periods F1 and F2 and the grayscale value of 8 during the third and fourth frame periods F3 and F4.

As the dither processor 113 performs a dithering operation on the image signal DATA_S (shown in FIG. 4) of the spot area SA using the dither patterns DTP that are temporally and spatially distributed, the present display device DD can prevent a spot from being observed in an area detected as the spot area SA in the display surface DS.

Figure 9:
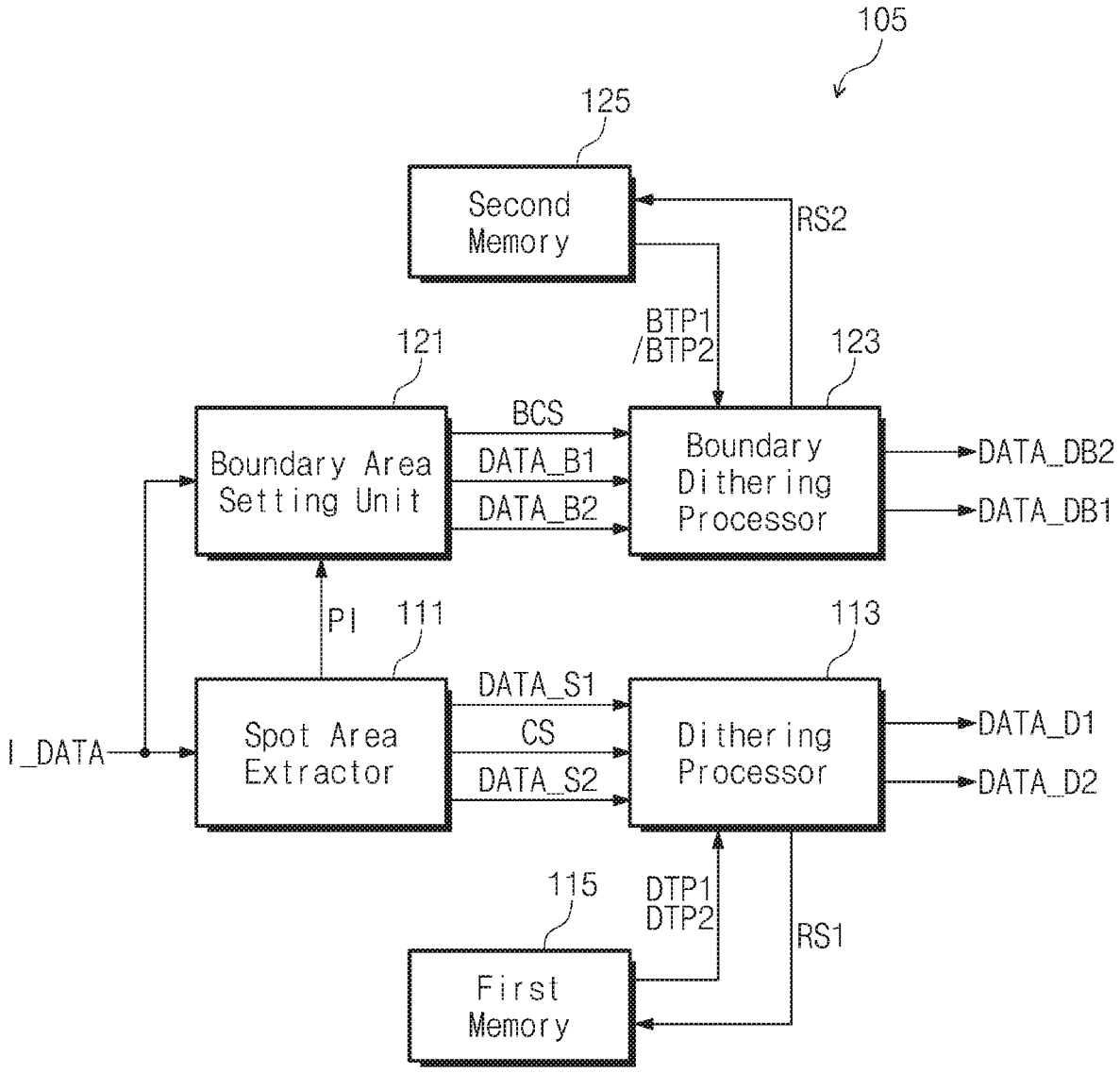
FIG. 9 is an internal block diagram showing a signal controller according to an example embodiment of the present disclosure.
Figure 10:
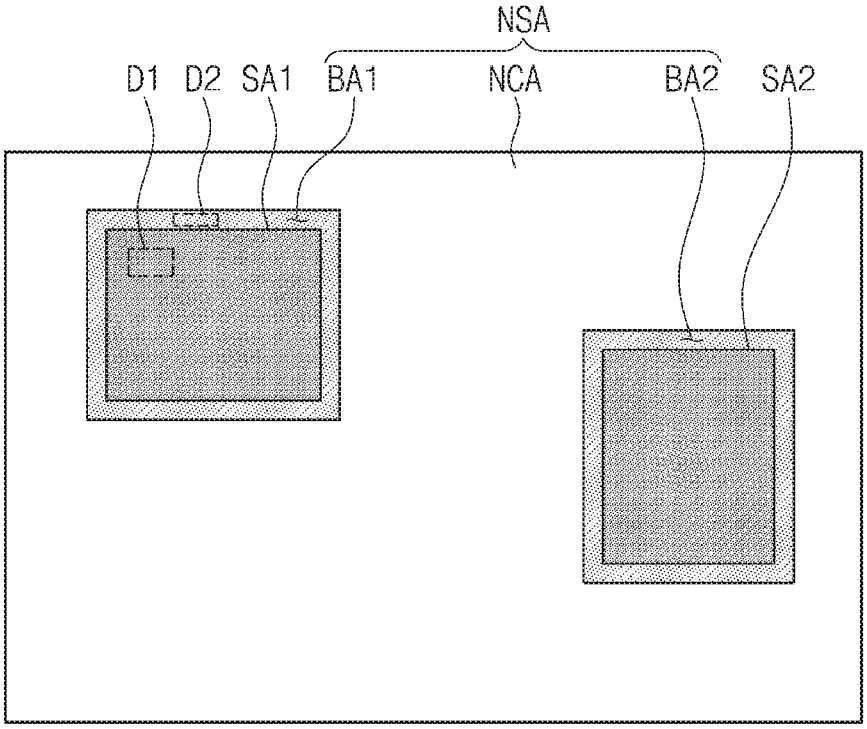
FIG. 10 is a plan view showing a display surface of a display panel according to an example embodiment of the present disclosure.

FIG. 9 is an internal block diagram showing a signal controller 105 according to an example embodiment of the present disclosure, and FIG. 10 is a plan view showing a display surface of a display panel DP according to an example embodiment of the present disclosure. In FIG. 9, the same reference numerals denote the same elements in FIG. 4, and detailed descriptions of the same elements will be omitted.

Referring to FIGS. 9 and 10, the signal controller 105 includes a spot area extractor 111, a dithering processor 113, a first memory 115, a boundary area setting unit 121, a boundary dithering processor 123, and a second memory 125.

The spot area extractor 111 and the boundary area setting unit 121 receive the input image signal I_DATA from an external device (not shown). The spot area extractor 111 may extract spot areas SA1 and SA2 in which a spot appears on the display surface DS of the display panel DP (shown in FIG. 1) based on the input image signal I_DATA. The display surface DS includes the spot areas SA1 and SA2 in which the spot appears and a non-spot area NSA in which no spot appears. As an example, the spot areas SA1 and SA2 include a first spot area SA1 and a second spot area SA2. The first and second spot areas SA1 and SA2 may be different from each other in their sizes and/or shapes.

The non-spot area NSA may include boundary areas BA1 and BA2 surrounding the spot areas SA1 and SA2, respectively. In the non-spot area NSA, a remaining area except for the boundary areas BA1 and BA2 may correspond to a non-compensation area NCA. That is, the non-spot area NSA includes the boundary areas BA1 and BA2 and the non-compensation area NCA. As shown in FIG. 10, the boundary areas BA1 and BA2 include a first boundary area BA1 surrounding the first spot area SA1 and a second boundary area BA2 surrounding the second spot area SA2.

When the spot area extractor 111 detects the first and second spot areas SA1 and SA2, the spot area extractor 111 provides a first image signal DATA_S1 that corresponds to the first spot area SA1 in the input image signal I_DATA and a second image signal DATA_S2 that corresponds to the second spot area SA2 in the input image signal I_DATA to the dithering processor 113.

The dithering processor 113 performs a dithering operation on the first and second image signals DATA_S1 and DATA_S2 received from the spot area extractor 111. In the present example embodiment, the dithering operation performed on the first spot area SA1 is referred to as a "first dithering operation," and the dithering operation performed on the second spot area SA2 is referred to as a "second dithering operation,"

The dithering processor 113 receives first dither patterns DTP1 and second dither patterns DTP2 from the first memory 115 to perform the first and second dithering operations, respectively. The first memory 115 may include a look-up table storing the first dither patterns DTP1 for the first image signal DATA_S1 and the second dither patterns DTP2 for the second image signal DATA_S2. In one embodiment, the dithering processor 113 may send a request signal RS1 to the first memory 115, and the first memory 115 provides the first and second dither patterns DTP1 and DTP2 to the dithering processor 113.

The dithering processor 113 reflects the first dither patterns DTP1 received from the first memory 115 to the first image signal DATA_S1 and outputs a first compensation image signal DATA_D1, and reflects the second dither patterns DTP2 received from the first memory 115 to the second image signal DATA_S2 and outputs a second compensation image signal DATA_D2.

The spot area extractor 111 may provide information PI about the extracted spot areas SA1 and SA2 to the boundary area setting unit 121. As an example, the information PI may include first information about the first spot area SA1 and second information about the second spot area SA2. The boundary area setting unit 121 sets the boundary areas BA1 and BA2 surrounding the spot areas SA1 and SA2 in the input image signal I_DATA based on the information PI and outputs image signals corresponding to the boundary areas BA1 and BA2 as boundary image signals DATA_B1 and DATA_B2 to the boundary dithering processor 123. In particular, the boundary area setting unit 121 outputs a first boundary image signal DATA_B1 corresponding to the first boundary area BA1 and a second boundary image signal DATA_B2 corresponding to the second boundary area BA2 to the boundary dithering processor 123. In addition, the boundary area setting unit 121 outputs a boundary compensation control signal BCS to the boundary dithering processor 123.

The boundary dithering processor 123 performs the dithering operation on the boundary image signals DATA_B1 and DATA_B2. The boundary dithering processor 123 performs the dithering operation on the boundary areas BA1 and BA2 in response to the boundary compensation control signal BCS received from the boundary area setting unit 121. Here, the dithering operation performed on the first boundary area BA1 is referred to as a "first boundary dithering operation," and the dithering operation performed on the second boundary area BA2 is referred to as a "second boundary dithering operation."

The boundary dithering processor 123 receives first boundary dither patterns BTP1 from the second memory 125 to perform the first boundary dithering operation and second boundary dither patterns BTP2 from the second memory 125 to perform the second boundary dithering operation. The second memory 125 includes a look-up table storing the first boundary dither patterns BTP1 for the first boundary image signal DATA_B1 and the second boundary dither patterns BTP2 for the second boundary image signal DATA_B2. In one embodiment, the boundary dithering processor 123 may send a request signal RS2 to the second memory 125, and the second memory 125 may provide the first and second boundary dither patterns BTP1 and BTP2 to the boundary dithering processor 123.

The boundary dithering processor 123 reflects the first boundary dither patterns BTP1 received from the second memory 125 to the first boundary image signal DATA_B1 and outputs a first boundary compensation image signal DATA_DB1, and reflects the second boundary dither patterns BTP2 received from the second memory 125 to the second boundary image signal DATA_B2 and outputs a second boundary compensation image signal DATA_DB2.

The signal controller 105 combines the first and second compensation image signals DATA_D1 and DATA_D2 that are output from the dithering processor 113 and the first and second boundary compensation image signals DATA_DB1 and DATA_DB2 that are output from the boundary dithering processor 123 with non-compensation image signals that correspond to the non-compensation area NCA and provides the combined signals to the data driver 300 (shown in FIG. 1).

Figure 11A:
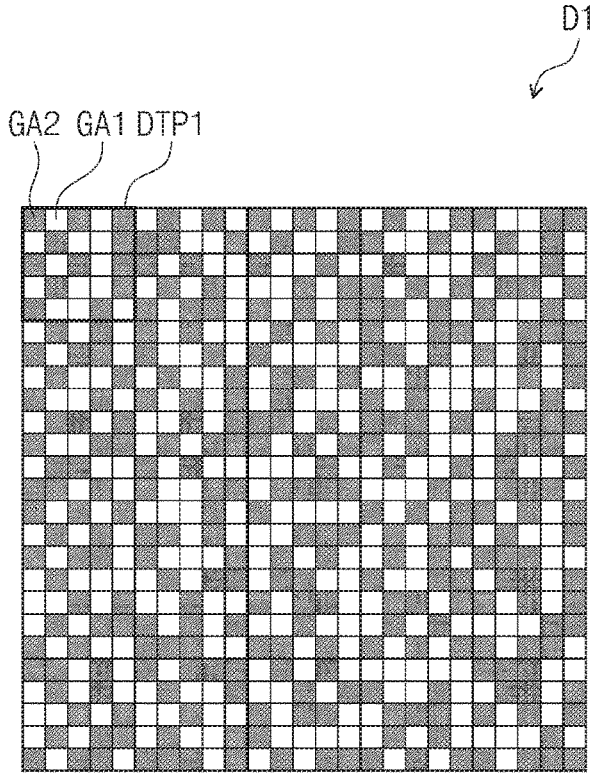
FIG. 11A shows an example of first dither patterns corresponding to an area D1 shown in FIG. 10.
Figure 11B:
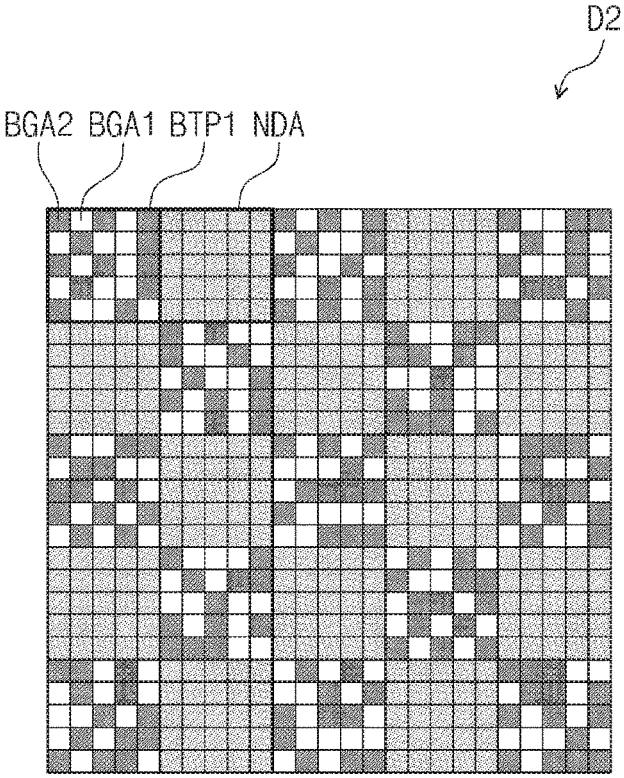
FIG. 11B shows an example of first boundary dither patterns corresponding to an area D2 shown in FIG. 10.
Figure 11C:
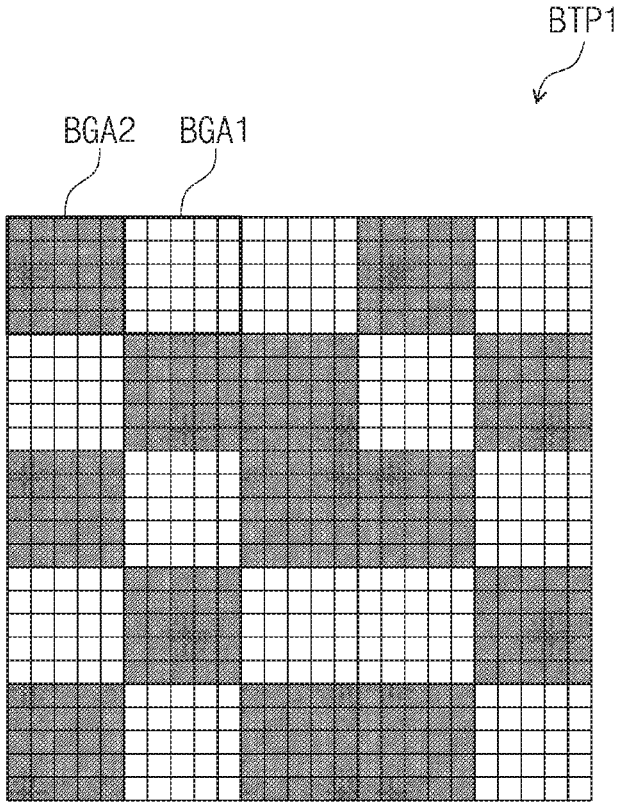
FIG. 11C shows an example of first boundary dither patterns according to another example embodiment of the present disclosure.

FIG. 11A shows an example of first dither patterns corresponding to an area D1 of the first spot area SA1 shown in FIG. 10, FIG. 11B shows an example of first boundary dither patterns corresponding to an area D2 in the first boundary area BA1 shown in FIG. 10, and FIG. 11C shows an example of first boundary dither patterns according to another example embodiment of the present disclosure.

FIG. 11A shows an example of the first dither patterns DTP1 corresponding to the area D1 of the first spot area SA1 shown in FIG. 10. A plurality of grayscale areas is defined in each of the first dither patterns DTP1. As an example, each of the first dither patterns DTP1 includes five by five (5×5) grayscale areas. However, this is merely an example, and the number of the gray scale areas should not be limited thereto or thereby. In the present example embodiment, the area D1 may correspond to an area having the same target grayscale value. The first spot area SA1 may include a plurality of areas having target grayscale values that are different from each other.

The grayscale areas are classified into a first grayscale area GA1 and a second grayscale area GA2. The first grayscale area GA1 may correspond to an area having a grayscale value higher than a target grayscale value to be displayed in the area D1, and the second grayscale area GA2 may correspond to an area having a grayscale value lower than the target grayscale value. Therefore, a difference in grayscale between the first grayscale area GA1 and the second grayscale area GA2 may be greater than one grayscale. In one embodiment of the present disclosure, an average value of the grayscale value of the first grayscale area GA1 and the grayscale value of the second grayscale area GA2 may be substantially the same as the target grayscale value.

As an example, each of the first and second grayscale areas GA1 and GA2 may correspond to an area corresponding to one pixel area in which each pixel PX of the display panel DP shown in FIG. 1 is disposed.

FIG. 11B shows an example of the first boundary dither patterns BTP1 corresponding to the area D2 of the first boundary area BA1 shown in FIG. 10. The first boundary area BA1 includes boundary dithering areas that are dithered by the first boundary dither patterns BTP1 and non-dithering areas NDA that are not dithered. The first boundary dither patterns BTP1 may include a plurality of boundary grayscale areas. In one embodiment, each of the first boundary dither patterns BTP1 has substantially the same size as each of the first dither patterns DTP1. FIG. 11B shows that each of the first boundary dither patterns BTP1 includes five by five (5×5) boundary grayscale areas, however, the size of each of the first boundary dither patterns BTP1 should not be limited thereto or thereby. For example, the size of each of the first boundary dither patterns BTP1 may be greater or smaller than the size of each of the first dither patterns DTP1.

The boundary grayscale areas are classified into a first boundary grayscale area BGA1 and a second boundary grayscale area BGA2. The first boundary grayscale area BGA1 may correspond to an area having a grayscale value higher than a target grayscale value to be displayed in each of the first boundary dither patterns BTP1, and the second boundary grayscale area BGA2 may correspond to an area having a grayscale value lower than the target grayscale value. Therefore, a difference in grayscale between the first boundary grayscale area BGA1 and the second boundary grayscale area BGA2 may be greater than one grayscale. In one embodiment of the present disclosure, an average value of the grayscale value of the first boundary grayscale area BGA1 and the grayscale value of the second boundary grayscale area BGA2 may be substantially the same as the target grayscale value.

As shown in FIG. 11B, each of the first boundary dither patterns BTP1 has substantially the same size as the first dither patterns DTP1, and the size of each of the boundary grayscale areas BGA1 and BGA2 may be substantially the same as the size of each of the grayscale areas GA1 and GA2 shown in FIG. 11A.

As shown in FIG. 11B, the non-dithering area NDA is disposed between the boundary dithering areas that are dithered by the first boundary dither patterns BTP1, therefore a density of the first boundary dither patterns BTP1 in the first boundary area BA1 is smaller than a density of the first dither patterns DTP1 in the first spot area SA1. That is, the number of the first boundary dither patterns BTP1 is smaller than the number of the first dither patterns DTP1 within an area of the same size.

FIG. 11C shows an example embodiment in which the size of each of the boundary grayscale areas BGA1 and BGA2 is greater than the size of each of the grayscale areas GA1 and GA2 (shown in FIG. 11A). In the present example, the first boundary grayscale area BGA1 has a size that is 5×5 times greater than that of the first grayscale area GA1 of the first dither pattern DTP1 (shown in FIG. 11A). That is, each of the first and second grayscale areas GA1 and GA2 may correspond to one pixel area, but each of the first and second boundary grayscale areas BGA1 and BGA2 may correspond to five by five (5×5) pixel areas. In this case, each of the first boundary dither patterns BTP1 may have the size that is 5×5 times greater than that of each of the first dither pattern DTP1. However, the size of and the number of pixel areas in each of the first boundary dither patterns BTP1 should not be limited thereto or thereby and may be changed in various ways. As described above, as each of the first boundary dither patterns BTP1 may have a size greater than that of the first dither patterns DTP1, the density of the first boundary dither patterns BTP1 in the first boundary area BA1 may be smaller than that of the first dither patterns DTP1 in the first spot area SA1.

As the boundary areas BA1 and BA2 on which the boundary dithering operation is performed using the boundary dither patterns BTP1 and BTP2 are provided in a density lower than that of the dither patterns DTP1 and DPT2 of the spot areas SA1 and SA2 and are disposed between the spot areas SA1 and SA2 and the non-compensation area NCA. As a result, the present display device DD may prevent a phenomenon in which the boundary between the spot area and the non-compensation area NCA is observable to a user.

Figure 12:
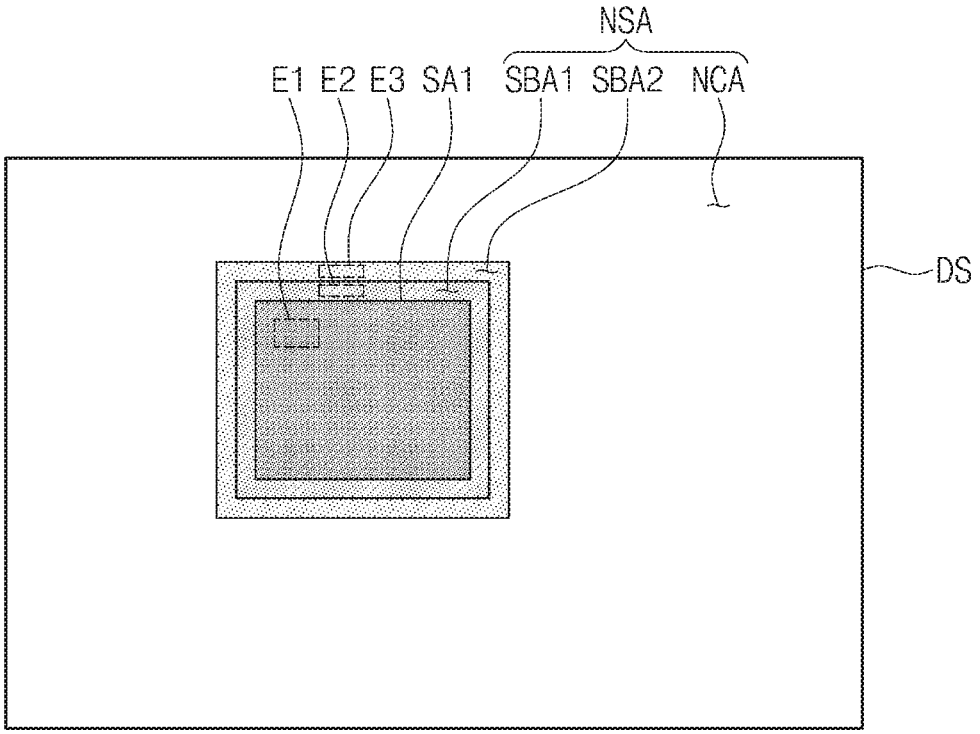
FIG. 12 is a plan view showing a display surface of a display panel according to an example embodiment of the present disclosure.

FIG. 12 is a plan view showing a display surface DS of a display panel DP according to an example embodiment of the present disclosure.

Referring to FIG. 12, the display surface DS includes a spot area SA1 in which a spot appears and a non-spot area NSA in which no spot appears. The non-spot area NSA may include a first sub-boundary area SBA1 surrounding the spot area SA1 and a second sub-boundary area SBA2 surrounding the first sub-boundary area SBA1. In the non-spot area NSA, a remaining area except for the first and second sub-boundary areas SBA1 and SBA2 may correspond to a non-compensation area NCA. That is, the non-spot area NSA includes the first and second sub-boundary areas SBA1 and SBA2 and the non-compensation area NCA.

FIG. 12 shows two sub-boundary areas SBA1 and SBA2 surrounding the spot area SA1, however, the number of the sub-boundary areas surrounding the spot area SA1 should not be limited to two. That is, two or more sub-boundary areas may be defined around the spot area SA1.

Figure 13A:
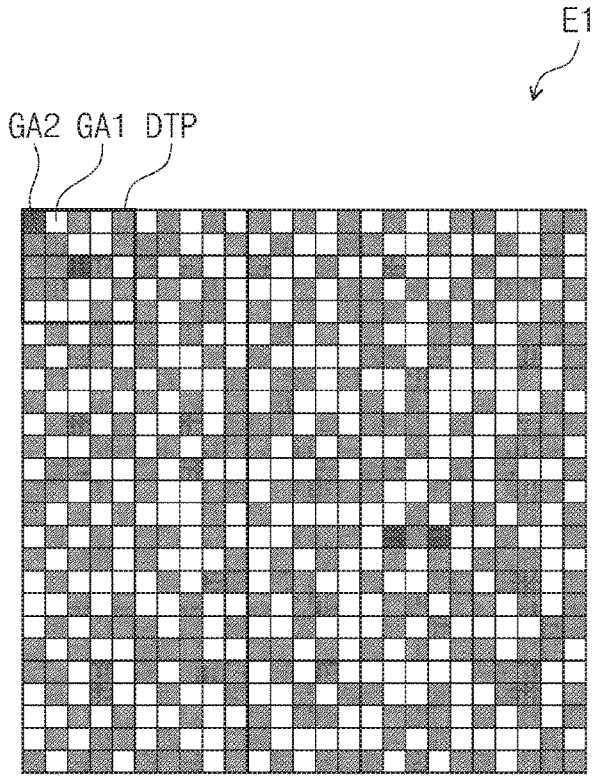
FIG. 13A shows first dither patterns of an area E1 shown in FIG. 12.
Figure 13B:
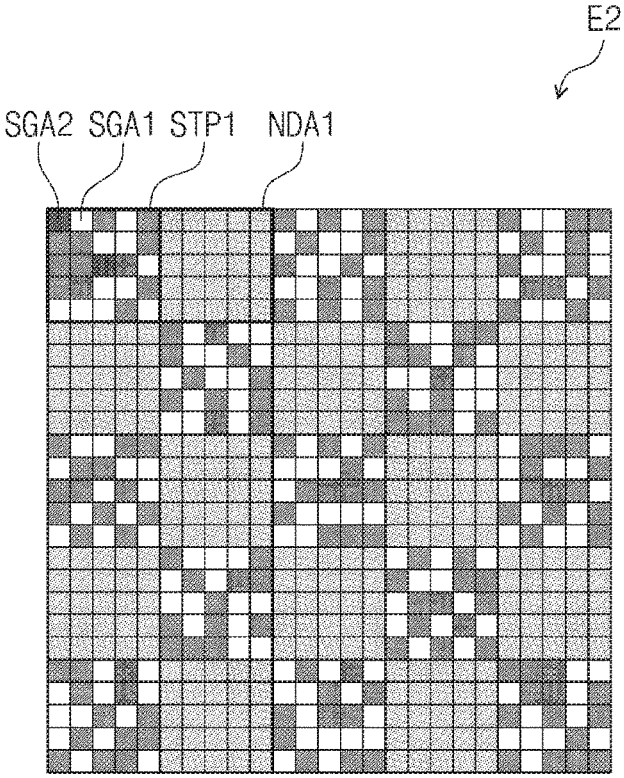
FIG. 13B shows first sub-boundary dither patterns of an area E2 shown in FIG. 12.
Figure 13C:
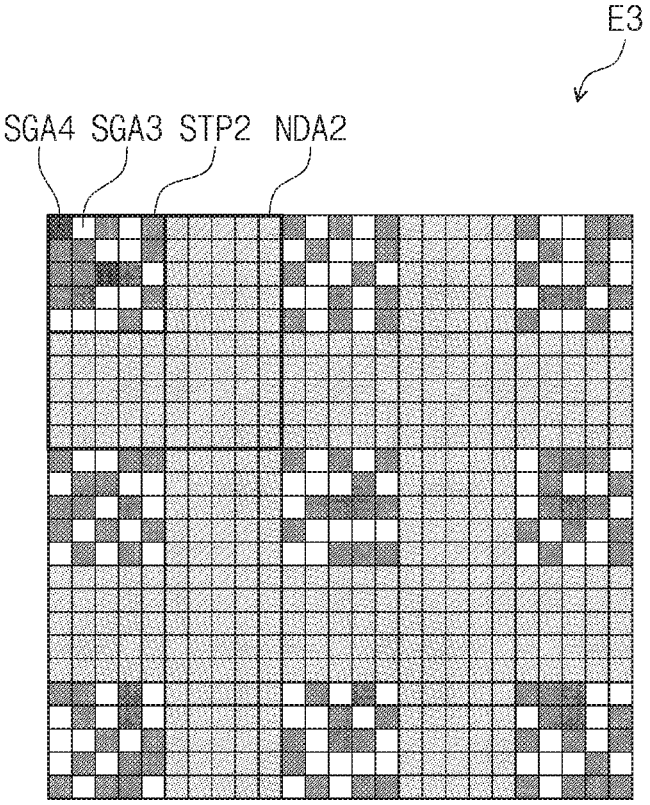
FIG. 13C shows second sub-boundary dither patterns of an area E3 shown in FIG. 12.

FIG. 13A shows first dither patterns of an area E1 shown in FIG. 12, FIG. 13B shows first sub-boundary dither patterns of an area E2 shown in FIG. 12, and FIG. 13C shows second sub-boundary dither patterns of an area E3 shown in FIG. 12.

FIG. 13A shows an example of the dither patterns DTP corresponding to the area E1 of the spot area SA1 shown in FIG. 12. A plurality of grayscale areas is defined in each of the dither patterns DTP. As an example, each of the dither patterns DTP includes five by five (5×5) grayscale areas. However, this is merely an example, and the number of the grayscale areas should not be limited thereto or thereby. In the present example embodiment, the area E1 may correspond to an area having the same target grayscale value. The spot area SA1 may include a plurality of areas having target grayscale values that are different from each other.

The grayscale areas are classified into a first grayscale area GA1 and a second grayscale area GA2. The first grayscale area GA1 may correspond to an area having a grayscale value higher than the target grayscale value to be displayed in the area E1, and the second grayscale area GA2 may correspond to an area having a grayscale value lower than the target grayscale value. Therefore, a difference in grayscale between the first grayscale area GA1 and the second grayscale area GA2 may be greater than one grayscale. In one embodiment of the present disclosure, an average value of the grayscale value of the first grayscale area GA1 and the grayscale value of the second grayscale area GA2 may be substantially the same as the target grayscale value.

As an example, each of the first and second grayscale areas GA1 and GA2 may correspond to an area corresponding to one pixel area in which each pixel PX of the display panel DP shown in FIG. 1 is disposed.

Referring to FIG. 13B shows an example of the first sub-boundary dither patterns STP1 corresponding to the area E2 of the first sub-boundary area SBA1 shown in FIG. 12. The first sub-boundary area SBA1 includes sub-boundary dithering areas that are dithered by the first sub-boundary dither patterns STP1 and first non-dithering areas NDA1 that are not dithered. The first sub-boundary dither patterns STP1 may include a plurality of sub-boundary grayscale areas. In one embodiment, each of the first sub-boundary dither patterns STP1 has substantially the same size as the dither patterns DTP. FIG. 13B shows that each of the first sub-boundary dither patterns STP1 includes five by five (5×5) sub-boundary grayscale areas, however, the size of the first sub-boundary dither patterns STP1 should not be limited thereto or thereby. For example, the size of each of the first sub-boundary dither patterns STP1 may be greater or smaller than the size of each of the dither patterns DTP.

The sub-boundary grayscale areas are classified into a first sub-boundary grayscale area SGA1 and a second sub-boundary grayscale area SGA2. The first sub-boundary grayscale area SGA1 may correspond to an area having a grayscale value higher than a target grayscale value to be displayed in the area E2, and the second sub-boundary grayscale area SGA2 may correspond to an area having a grayscale value lower than the target grayscale value. Therefore, a difference in grayscale between the first sub-boundary grayscale area SGA1 and the second sub-boundary grayscale area SGA2 may be greater than one grayscale. In one embodiment of the present disclosure, an average value of the grayscale value of the first sub-boundary grayscale area SGA1 and the grayscale value of the second sub-boundary grayscale area SGA2 may be substantially the same as the target grayscale value.

As shown in FIG. 13B, each of the first sub-boundary dither patterns STP1 has substantially the same size as the dither patterns DTP, and the size of each of the sub-boundary grayscale areas SGA1 and SGA2 may be substantially the same as the size of each of the grayscale areas GA1 and GA2 shown in FIG. 13A.

As shown in FIG. 13B, the first non-dithering area NDA1 is disposed between the sub-boundary dithering areas that are dithered by the first sub-boundary dither patterns STP1, therefore a density of the first sub-boundary dither patterns STP1 in the first sub-boundary area SBA1 is smaller than a density of the dither patterns DTP in the spot area SA1. That is, the number of the first sub-boundary dither patterns STP1 is smaller than the number of the dither patterns DTP within an area of the same size.

FIG. 13B shows that the first sub-boundary dither patterns STP1 and the first non-dithering area NDA1 have substantially the same size, however, the present disclosure should not be limited thereto or thereby. In some embodiments, the first non-dithering area NDA1 may have a size of half each of the first sub-boundary dither patterns STP1 or two times greater than a size of each of the first sub-boundary dither patterns STP1.

FIG. 13C shows an example of the second sub-boundary dither patterns STP2 corresponding to the area E3 of the second sub-boundary area SBA2 shown in FIG. 12. The second sub-boundary area SBA2 includes sub-boundary dithering areas that are dithered by the second sub-boundary dither patterns STP2 and second non-dithering areas NDA2 that are not dithered. The second sub-boundary dither patterns STP2 may include a plurality of sub-boundary grayscale areas. In one embodiment, each of the second sub-boundary dither patterns STP2 has substantially the same size as the dither patterns DTP. FIG. 13C shows that each of the second sub-boundary dither patterns STP2 includes five by five (5×5) sub-boundary grayscale areas, however, the size of the second sub-boundary dither patterns STP2 should not be limited thereto or thereby. For example, the size of each of the second sub-boundary dither patterns STP2 may be greater or smaller than the size of the dither patterns STP1.

The second sub-boundary dither patterns STP2 include a plurality of sub-boundary grayscale areas. As an example, each of the second sub-boundary dither patterns STP2 includes five by five (5×5) sub-boundary grayscale areas. However, this is merely an example, and the number of the sub-boundary grayscale areas included in the second sub-boundary dither patterns STP2 should not be limited thereto or thereby.

The sub-boundary grayscale areas are classified into a third sub-boundary grayscale area SGA3 and a fourth sub-boundary grayscale area SGA4. The third sub-boundary grayscale area SGA3 may correspond to an area having a grayscale value higher than a target grayscale value to be displayed in the area E3, and the fourth sub-boundary grayscale area SGA4 may correspond to an area having a grayscale value lower than the target grayscale value. Therefore, a difference in grayscale between the third sub-boundary grayscale area SGA3 and the fourth sub-boundary grayscale area SGA4 may be greater than one grayscale. In one embodiment of the present disclosure, an average value of the grayscale value of the third sub-boundary grayscale area SGA3 and the grayscale value of the fourth sub-boundary grayscale area SGA4 may be substantially the same as the target grayscale value.

As shown in FIG. 13C, each of the second sub-boundary dither patterns STP2 has substantially the same size as each of the dither patterns DTP, and the size of each of the sub-boundary grayscale areas SGA3 and SGA4 may be substantially the same as the size of each of the grayscale areas GA1 and GA2 shown in FIG. 13A.

As shown in FIG. 13C, the second non-dithering area NDA2 is disposed between the sub-boundary dithering areas that are dithered by the second sub-boundary dither patterns STPs, therefore a density of the second sub-boundary dither patterns STP2 in the second sub-boundary area SBA2 is smaller than a density of the dither patterns DTP in the spot area SA1. That is, the number of the second sub-boundary dither patterns STP2 is smaller than the number of the dither patterns DTP within an area of the same size. In addition, the density of the second sub-boundary dither patterns STP2 in the second sub-boundary area SBA2 is smaller than the density of the first sub-boundary dither patterns STP1 in the first sub-boundary area SBA1.

In FIG. 13C, the second non-dithering area NDA2 has a size greater than the second sub-boundary dither patterns STP2 and the first non-dithering area NDA1 shown in FIG. 13B. In one embodiment, the second non-dithering area NDA2 has a size three times greater than the first non-dithering area NDA1. However, the present disclosure should not be limited thereto or thereby. In some embodiments, the second non-dithering area NDA2 may have a size that is 1.5, 2, or 2.5 times greater than the first non-dithering area NDA1.

FIGS. 12 and 13A to 13C show an example of two sub-boundary areas SBA1 and SBA2 arranged around the spot area SA1, however, the present disclosure should not be limited thereto or thereby. That is, three or more sub-boundary areas may be arranged around the spot area SA1, and the size of the non-dithering areas NDA1 and NDA2 in each of the sub-boundary areas SBA1 and SBA2 may gradually increase based on a distance away from the spot area SA1.

As described above, the sub-boundary areas SBA1 and SBA2 may be disposed between the spot area SA1 and the non-compensation area NCA, and the density of the sub-boundary dither patterns STP1 and STP2 in the sub-boundary areas SBA1 and SBA2 gradually decreases based on a distance away from the spot area SA1. Thus, the display device DD may efficiently improve a display quality by preventing a boundary that may be observable between the spot area SA1 and the non-compensation area NCA.

Figure 14:
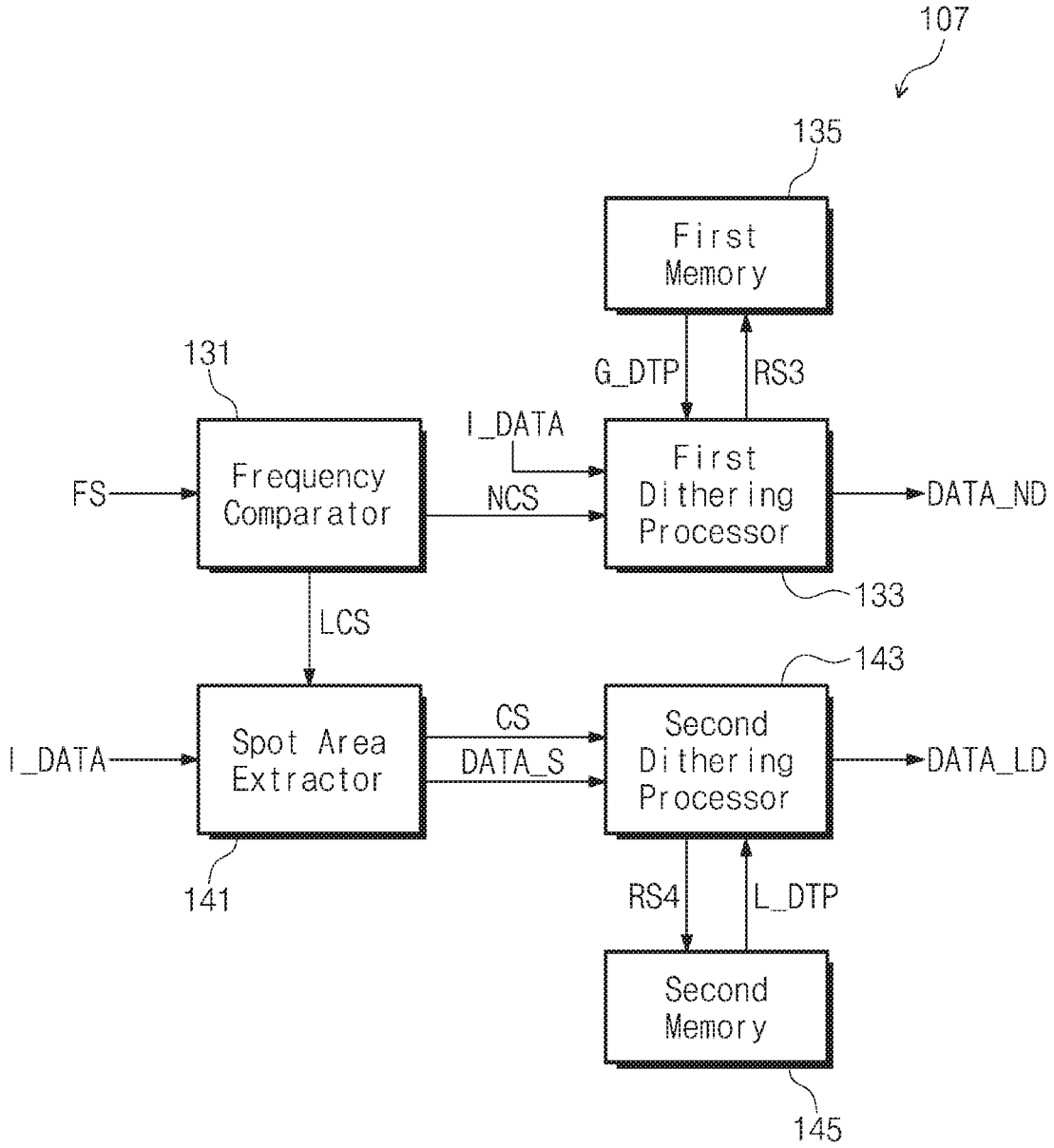
FIG. 14 is an internal block diagram showing a signal controller according to an example embodiment of the present disclosure.
Figure 15A:
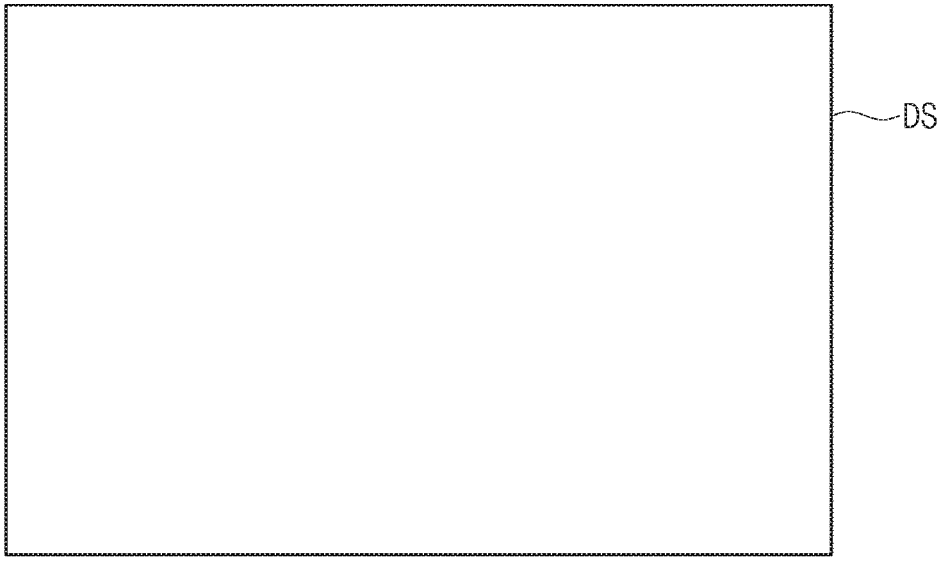
FIG. 15A is a plan view showing a display surface of a display panel in a normal mode.
Figure 15B:
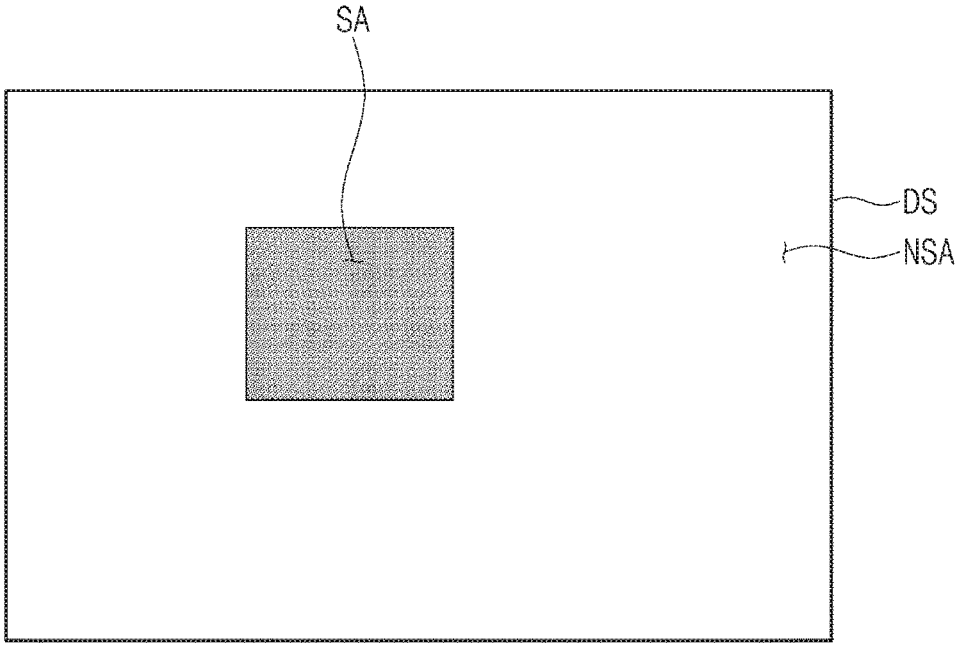
FIG. 15B is a plan view showing a display surface of a display panel in a low frequency mode.

FIG. 14 is an internal block diagram showing a signal controller 107 according to an example embodiment of the present disclosure, FIG. 15A is a plan view showing a display surface DS of a display panel DP in a normal mode (herein also referred to as N-mode), and FIG. 15B is a plan view showing a display surface DS of a display panel DP in a low frequency mode (herein also referred to as L-mode).

Referring to FIGS. 14, 15A, and 15B, the signal controller 107 includes a frequency comparator 131, a first memory 135, a first dithering processor 133, a spot area extractor 141, a second memory 145, and a second dithering processor 143.

The frequency comparator 131 compares a driving frequency FS of the display panel DP (shown in FIG. 1) with a predetermined reference frequency. As an example, the reference frequency is about 60 Hz. The frequency comparator 131 determines a mode of operation (e.g., the normal mode and the low frequency mode) by comparing the driving frequency FS with respect to the reference frequency. For example, the display panel DP is driven in the normal mode if the driving frequency FS being equal to or greater than the reference frequency and driven in the low frequency mode if the driving frequency FS is smaller than the reference frequency.

Based on the determination that the display panel DP is driven in the normal mode N-mode, the frequency comparator 131 provides a first compensation control signal NCS to the first dithering processor 133. The first dithering processor 133 may perform a dithering operation on an entire area of the display surface DS. That is, the first dithering processor 133 may perform a global dithering operation on the entire input image signal I_DATA in response to the first compensation control signal NCS.

The first dithering processor 133 may receive global dither patterns G_DTP with respect to an entire area of the display surface DS from the first memory 135 and perform the global dithering operation. The first memory 135 may include a look-up table storing the global dither patterns G_DTP with respect to the input image signal I-DATA. In one embodiment, the first dithering processor 133 sends a first request signal RS3 to the first memory 135, and the first memory 135 provides the global dither patterns G_DTP to the first dithering processor 133.

The first dithering processor 133 reflects the global dither patterns G_DTP received from the first memory 135 to the input image signal I_DATA and outputs a first compensation image signal DATA_ND. Accordingly, the signal controller 107 provides the first compensation image signal DATA_ND with respect to the entire area of the display surface DS to the data driver 300 (shown in FIG. 1) in the normal mode.

Based on the determination that the display panel DP is driven in the low frequency mode, the frequency comparator 131 provides a second compensation control signal LCS to the spot area extractor 141. The spot area extractor 141 also receives the input image signal I_DATA and extracts a spot area SA where a spot appears on the display surface DS of the display panel DP based on the input image signal I_DATA. The display surface DS may include the spot area SA where a spot appears and a non-spot area NSA where no spot appears.

When the spot area extractor 141 detects the spot area SA, the spot area extractor 141 provides an image signal DATA_S corresponding to the detected spot area SA in the input image signal I_DATA to the second dithering processor 143. In addition, the spot area extractor 141 outputs a third compensation control signal CS to control an operation of the second dithering processor 143. The second dithering processor 143 may perform a local dithering operation that dithers a portion of the image signal DATA_S corresponding to the spot area SA in the input image signal I_DATA in response to the third compensation control signal CS.

The second dithering processor 143 may receive local dither patterns L_DTP with respect to the spot area SA from the second memory 145 and perform the local dithering operation. The second memory 145 may include a look-up table storing the local dither patterns L_DTP with respect to the image signal DATA_S. In one embodiment, the second dithering processor 143 sends a second request signal RS4 to the second memory 145, and the second memory 145 provides the local dither patterns L_DTP to the second dithering processor 143.

The second dithering processor 143 reflects the local dither patterns L_DTP received from the second memory 145 to the image signal DATA_S and outputs a second compensation image signal DATA_LD. Accordingly, the signal controller 107 combines the second compensation image signal DATA_LD with respect to the spot area SA of the display surface DS with the non-compensation image signals corresponding to the non-spot area NSA in the low frequency mode and provides the combined signals to the data driver 300 (shown in FIG. 1).

As the dithering operation may be performed only on the spot area SA instead of on the entire area of the display surface DS in the low frequency mode, the present display panel DP may prevent a flicker phenomenon when a spot is corrected. As a result, the display panel DP may improve the display quality when operating in the low frequency mode.

Although the example embodiments of the present disclosure have been described, it is understood that the present disclosure should not be limited to these example embodiments but various changes and modifications can be made by one ordinary skilled in the art within the spirit and scope of the present disclosure as hereinafter claimed.

Therefore, the disclosed subject matter should not be limited to any single embodiment described herein, and the scope of the present inventive concept shall be determined according to the attached claims.

What is claimed is:

1. A display device comprising:

a display panel comprising a display surface;

a memory storing dither patterns with respect to at least one spot area included in the display surface;

a dithering processor selecting a dither pattern among the dither patterns in a first predetermined time unit and outputting a compensation image signal corresponding to the selected dither pattern; and a panel driver outputting a data signal corresponding to the spot area based on the compensation image signal, wherein a first dither pattern of the dither patterns comprises a first grayscale area having a first grayscale value higher than a first target grayscale value of the spot area during a first frame and a second grayscale area having a second grayscale value lower than the first target grayscale value during the first frame, wherein a difference in grayscale between the first grayscale value of the first grayscale area and the second grayscale value of the second grayscale area during the first frame is equal to or greater than two grayscale, a difference in grayscale between the first grayscale value of the first grayscale area and the first target grayscale value is equal to or greater than one grayscale, and a difference in grayscale between the second grayscale value of the second grayscale area and the first target grayscale value is equal to or greater than one grayscale.

2. The display device of claim 1, wherein the first target grayscale value corresponds to an average value of the first grayscale value of the first grayscale area and the second grayscale value of the second grayscale area.

3. The display device of claim 1, wherein the display surface further comprises a non-spot area, and the non-spot area comprises a non-compensation area and a boundary area between the non-compensation area and the spot area.

4. The display device of claim 3, further comprising:

a boundary memory storing boundary dither patterns with respect to the boundary area; and a boundary dithering processor selecting a boundary dither pattern among the boundary dither patterns in a second predetermined time unit and outputting a boundary compensation image signal corresponding to the boundary dither pattern, wherein each of the boundary dither patterns comprises a third grayscale area having a third grayscale value higher than a second target grayscale value of the boundary area and a fourth grayscale area having a fourth grayscale value lower than the second target grayscale value.

5. The display device of claim 4, wherein the boundary area comprises a boundary dithering area in which the boundary dithering processor performs a dithering operation using the boundary dither patterns and a non-dithering area in which the boundary dithering processor performs no dithering operation.

6. The display device of claim 5, wherein the third grayscale area and the fourth grayscale area have a same size as a size of the first grayscale area and the second grayscale area.

7. The display device of claim 4, wherein the third grayscale area and the fourth grayscale area have a size greater than a size of the first grayscale area and the second grayscale area.

8. The display device of claim 4, wherein a difference in grayscale between the third grayscale value of the third grayscale area and the fourth grayscale value of the fourth grayscale area is equal to or greater than 2.

9. The display device of claim 4, wherein the boundary area comprises a plurality of sub-boundary areas, and the boundary memory stores sub-compensation patterns with respect to the sub-boundary areas.

10. The display device of claim 9, wherein each of the sub-compensation patterns comprises a first sub-grayscale area having a fifth grayscale value higher than a third target grayscale value of each of the sub-boundary areas and a second sub-grayscale area having a sixth grayscale value lower than the third target grayscale value.

11. The display device of claim 10, wherein each of the sub-boundary areas comprises a sub-boundary dithering area in which the boundary dithering processor performs a sub-boundary dithering operation using the boundary dither patterns and a non-dithering area in which the boundary dithering processor performs no sub-boundary dithering operation, and a size of the non-dithering area gradually increases based on a distance away from the spot area.

12. The display device of claim 11, wherein the first sub-boundary area and the second sub-boundary area have a same size as a size of the first grayscale area and the second grayscale area.

13. The display device of claim 10, wherein a difference in grayscale between the fifth grayscale value of the first sub-boundary grayscale area and the sixth grayscale value of the second sub-boundary grayscale area is equal to or greater than 2.

14. The display device of claim 1, further comprising a spot area extractor that extracts the spot area in the display surface of the display panel.

15. A method of driving a display device, comprising:

extracting at least one spot area in a display surface of a display panel;

selecting a dither pattern among dither patterns with respect to the spot area in a first predetermined time unit;

compensating for an image signal corresponding to the spot area based on the selected dither pattern and outputting a compensation image signal;

generating a data signal with respect to the spot area based on the compensation image signal; and providing the data signal to the display panel, wherein a first dither pattern of the dither patterns comprises a first grayscale area having a first grayscale value higher than a first target grayscale value of the spot area during a first frame and a second grayscale area having a second grayscale value lower than the first target grayscale value during the first frame, wherein a difference in grayscale between the first grayscale value of the first grayscale area and the second grayscale value of the second grayscale area during the first frame is equal to or greater than two grayscale, a difference in grayscale between the first grayscale value of the first grayscale area and the first target grayscale value is equal to or greater than one grayscale, and a difference in grayscale between the second grayscale value of the second grayscale area and the first target grayscale value is equal to or greater than one grayscale.

16. The method of claim 15, wherein the first target grayscale value corresponds to an average value of the first grayscale value of the first grayscale area and the second grayscale value of the second grayscale area.

17. The method of claim 15, wherein the display surface further comprises a non-spot area, and the non-spot area comprises a non-compensation area and a boundary area between the non-compensation area and the spot area.

18. The method of claim 17, further comprising selecting a boundary dither pattern among boundary dither patterns with respect to the boundary area in a second predetermined time unit, wherein each of the boundary dither patterns comprises a first boundary grayscale area having a third grayscale value higher than a second target grayscale value of the boundary area and a second boundary grayscale area having a fourth grayscale value lower than the second target grayscale value.

19. The method of claim 18, wherein a difference in grayscale between the third grayscale value of the first boundary grayscale area and the fourth grayscale value of the second boundary grayscale area is equal to or greater than 2.

20. A display device comprising:

a display panel comprising a display surface;

a frequency comparator comparing a driving frequency of the display panel with a predetermined reference frequency;

a first memory storing global dither patterns with respect to an entire area of the display surface;

a second memory storing local dither patterns with respect to at least one spot area included in the display surface;

a first dithering processor selecting a global dither pattern among the global dither patterns in a predetermined time unit and outputting a first compensation image signal corresponding to the selected global dither pattern in a normal mode, the driving frequency being equal to or greater than the reference frequency in the normal mode;

a second dithering processor selecting a local dither pattern among the local dither patterns in the predetermined time unit and outputting a second compensation image signal corresponding to the selected local dither pattern in a low frequency mode, the driving frequency being smaller than the reference frequency in the low frequency mode; and a panel driver outputting a global data signal with respect to the entire area based on the first compensation image signal in the normal mode and outputting a local data signal with respect to the spot area based on the second compensation image signal in the low frequency mode, wherein each of the local dither patterns comprises a first grayscale area having a first grayscale value higher than a first target grayscale value of the spot area and a second grayscale area having a second grayscale value lower than the first target grayscale value, and wherein each of the global dither patterns comprises a third grayscale area having a third grayscale value higher than a second target grayscale value of the entire area and a fourth grayscale area having a fourth grayscale value lower than the second target grayscale value.

21. The display device of claim 20, wherein a difference in grayscale between the first grayscale value of the first grayscale area and the second grayscale value of the second grayscale area is equal to or greater than 2, and a difference in grayscale between the third grayscale value of the third grayscale area and the fourth grayscale value of the fourth grayscale area is equal to or greater than 2.

22. The display device of claim 21, wherein the first target grayscale value corresponds to an average value of the first grayscale value of the first grayscale area and the second grayscale value of the second grayscale area, and the second target grayscale value corresponds to an average value of the third grayscale value of the third grayscale area and the fourth grayscale value of the fourth grayscale area.

23. The display device of claim 20, further comprising a spot area extractor that extracts the spot area.

* * * * *